US012778364B2

(12) United States Patent
Conrad

(10) Patent No.: US 12,778,364 B2
(45) **Date of Patent: *Nov. 3, 2026**

(54) SURFACE CLEANING APPARATUS

(71) Applicant: Omachron Intellectual Property Inc., Hampton (CA)

(72) Inventor: Wayne Ernest Conrad, Hampton (CA)

(73) Assignee: Omachron Intellectual Property Inc., Hampton (CA)

( * ) Notice: Subject to any disclaimer, the term of this patent is extended or adjusted under 35 U.S.C. 154(b) by 360 days.

This patent is subject to a terminal disclaimer.

(21) Appl. No.: 18/597,664

(22) Filed: Mar. 6, 2024

(65) Prior Publication Data

US 2025/0281014 A1 Sep. 11, 2025

(51) Int. Cl.
*A47L 5/24* (2006.01)
*A47L 9/28* (2006.01)
*A47L 9/32* (2006.01)

(52) U.S. Cl.
CPC ..... *A47L 5/24* (2013.01); *A47L 9/2831* (2013.01); *A47L 9/322* (2013.01)

(58) Field of Classification Search
CPC ..... A47L 5/24; A47L 5/28; A47L 5/32; A47L 9/16; A47L 9/1608
See application file for complete search history.

(56) References Cited

U.S. PATENT DOCUMENTS 4,905,342 A 3/1990 Ataka
5,267,371 A 12/1993 Soler et al.
5,358,290 A 10/1994 Fleet et al.
5,970,572 A 10/1999 Thomas
5,974,625 A 11/1999 Garner
6,098,244 A 8/2000 Conrad et al.
6,099,661 A 8/2000 Conrad
6,101,672 A 8/2000 Conrad et al.
6,123,779 A 9/2000 Conrad et al.
6,129,775 A 10/2000 Conrad et al.
6,135,708 A 10/2000 Conrad et al.
6,168,716 B1 1/2001 Conrad et al.
6,170,119 B1 1/2001 Conrad et al.
6,173,474 B1 1/2001 Conrad
6,174,127 B1 1/2001 Conrad et al.
6,183,641 B1 2/2001 Conrad et al.
6,224,325 B1 5/2001 Conrad et al.
6,231,645 B1 5/2001 Conrad et al.
6,238,177 B1 5/2001 Conrad et al.
6,243,917 B1 6/2001 Conrad
(Continued)

FOREIGN PATENT DOCUMENTS

CA 2275675 A1 12/1999
CA 2288544 A1 5/2000
(Continued)

OTHER PUBLICATIONS

U.S. Appl. No. 09/343,479, filed Jun. 30, 1999.
(Continued)

*Primary Examiner* — Michael D Jennings
(74) *Attorney, Agent, or Firm* — Philip C. Mendes da Costa; SMART & BIGGAR LP

(57) ABSTRACT

A surface cleaning apparatus has an energy storage member unit with a first portion provided in the handle and a second portion provided in the main body of the apparatus.

20 Claims, 15 Drawing Sheets

(56) References Cited

U.S. PATENT DOCUMENTS 6,251,296 B1 6/2001 Conrad et al.
6,261,052 B1 7/2001 Conrad et al.
6,261,379 B1 7/2001 Conrad et al.
6,280,143 B1 8/2001 Parker et al.
6,307,358 B1 10/2001 Conrad
6,312,594 B1 11/2001 Conrad et al.
6,328,527 B1 12/2001 Conrad et al.
6,334,234 B1 1/2002 Conrad et al.
6,344,064 B1 2/2002 Conrad
6,434,785 B1 8/2002 Vandenbelt et al.
6,440,197 B1 8/2002 Conrad et al.
6,457,205 B1 10/2002 Conrad
6,533,834 B2 3/2003 Conrad et al.
6,599,340 B2 7/2003 Conrad et al.
6,782,585 B1 8/2004 Conrad et al.
7,329,294 B2 2/2008 Conrad
7,370,387 B2 5/2008 Walker et al.
7,740,675 B2 6/2010 Conrad
7,749,293 B2 7/2010 Conrad
7,776,120 B2 8/2010 Conrad
7,803,207 B2 9/2010 Conrad
7,811,345 B2 10/2010 Conrad
7,867,308 B2 1/2011 Conrad
7,931,716 B2 4/2011 Oakham
7,941,895 B2 5/2011 Conrad
8,117,712 B2 2/2012 Dyson et al.
8,127,398 B2 3/2012 Conrad
8,146,201 B2 4/2012 Conrad
8,151,407 B2 4/2012 Conrad
8,156,609 B2 4/2012 Milne et al.
8,176,596 B2 5/2012 Conrad
8,192,515 B2 6/2012 Conrad
8,225,456 B2 7/2012 Hkan et al.
8,292,979 B2 10/2012 Conrad
8,296,900 B2 10/2012 Conrad
8,347,455 B2 1/2013 Dyson et al.
8,349,428 B2 1/2013 Conrad
8,370,993 B2 2/2013 Conrad
8,375,508 B2 2/2013 Conrad
8,444,731 B2 5/2013 Gomiciaga-Pereda et al.
8,448,291 B2 5/2013 Conrad
8,479,358 B2 7/2013 Conrad
8,486,170 B2 7/2013 Conrad et al.
8,510,907 B2 8/2013 Conrad
8,533,904 B2 9/2013 Conrad
8,549,703 B2 10/2013 Smith
8,561,257 B2 10/2013 Conrad
8,567,005 B2 10/2013 Conrad
8,578,550 B2 11/2013 Conrad
8,578,553 B2 11/2013 Conrad
8,578,555 B2 11/2013 Conrad
8,590,102 B2 11/2013 Conrad
8,595,895 B2 12/2013 Smith
8,607,407 B2 12/2013 Conrad
8,621,709 B2 1/2014 Conrad
8,640,304 B2 2/2014 Conrad
8,646,147 B2 2/2014 Conrad
8,657,904 B2 2/2014 Smith
8,659,184 B2 2/2014 Conrad
8,673,487 B2 3/2014 Churchill
8,677,554 B2 3/2014 Conrad
8,677,558 B2 3/2014 Conrad
8,713,751 B2 5/2014 Conrad
8,813,305 B2 8/2014 Conrad
8,834,209 B2 9/2014 Conrad
8,869,344 B2 10/2014 Conrad
8,869,345 B2 10/2014 Conrad
8,869,348 B2 10/2014 Conrad
8,875,340 B2 11/2014 Conrad
8,875,342 B2 11/2014 Conrad
8,945,258 B2 2/2015 Smith
8,979,960 B2 3/2015 Smith
9,005,324 B2 4/2015 Smith
9,005,325 B2 4/2015 Smith
9,027,198 B2 5/2015 Conrad
9,027,203 B2 5/2015 Conrad et al.
9,066,642 B2 6/2015 Conrad
9,119,513 B2 9/2015 Conrad
9,161,666 B2 10/2015 Conrad
9,161,669 B2 10/2015 Conrad
9,167,944 B2 10/2015 Conrad
9,204,769 B2 12/2015 Conrad
9,204,773 B2 12/2015 Conrad
9,215,960 B2 12/2015 Conrad
9,226,633 B2 1/2016 Conrad et al.
9,227,151 B2 1/2016 Conrad
9,227,201 B2 1/2016 Conrad
9,232,881 B2 1/2016 Conrad
9,238,235 B2 1/2016 Conrad
9,295,995 B2 3/2016 Conrad
9,314,138 B2 4/2016 Conrad
9,314,139 B2 4/2016 Conrad et al.
9,320,401 B2 4/2016 Conrad
9,326,652 B2 5/2016 Conrad
9,364,127 B2 6/2016 Conrad
9,427,122 B2 8/2016 Conrad et al.
9,427,126 B2 8/2016 Conrad
9,433,332 B2 9/2016 Conrad
9,451,852 B2 9/2016 Conrad
9,451,855 B2 9/2016 Conrad
9,456,721 B2 10/2016 Conrad
9,492,045 B2 11/2016 Conrad
9,526,394 B2 12/2016 Conrad
9,572,463 B2 2/2017 Conrad
9,591,952 B2 3/2017 Conrad
9,591,958 B2 3/2017 Conrad
9,711,986 B2 7/2017 Sunderland et al.
9,775,484 B2 10/2017 Conrad
9,801,513 B2 10/2017 Conrad et al.
9,820,621 B2 11/2017 Conrad et al.
10,076,183 B2 9/2018 Conrad et al.
10,149,587 B2 12/2018 Conrad et al.
10,159,393 B2 12/2018 Conrad
10,201,260 B2 2/2019 Conrad et al.
10,214,349 B2 2/2019 Conrad
10,251,519 B2 4/2019 Conrad
10,357,136 B2 7/2019 Conrad
10,537,216 B2 1/2020 Conrad
10,537,219 B2 1/2020 Conrad et al.
10,568,477 B2 2/2020 Conrad
10,575,693 B2 3/2020 Conrad
10,667,663 B2 6/2020 Conrad
10,687,679 B2 6/2020 Conrad et al.
10,729,294 B2 8/2020 Conrad et al.
10,750,913 B2 * 8/2020 Conrad ..... A47L 9/1608
10,791,890 B2 10/2020 Conrad
10,791,896 B2 10/2020 Conrad
10,888,205 B2 1/2021 Conrad et al.
10,932,634 B2 3/2021 Conrad
10,959,588 B2 3/2021 Conrad et al.
11,013,378 B2 5/2021 Conrad
11,108,254 B2 8/2021 Conrad
11,135,602 B2 10/2021 Conrad
11,154,169 B2 10/2021 Conrad
11,198,085 B2 12/2021 Conrad et al.
11,213,179 B2 1/2022 Conrad
11,246,462 B2 2/2022 Conrad
11,285,495 B2 3/2022 Conrad
11,318,482 B2 5/2022 Conrad
11,478,116 B2 10/2022 Conrad
11,478,117 B2 10/2022 Conrad et al.
11,529,034 B2 12/2022 Conrad
11,534,041 B2 12/2022 Conrad
11,534,043 B2 12/2022 Conrad
11,534,702 B2 12/2022 Conrad
11,547,258 B2 1/2023 Conrad
11,571,097 B2 2/2023 Conrad
11,612,290 B2 3/2023 Conrad
11,641,995 B2 5/2023 Conrad
11,707,170 B2 7/2023 Conrad
11,737,621 B2 8/2023 Conrad
11,737,625 B2 8/2023 Conrad
11,745,131 B2 9/2023 Conrad
11,793,374 B2 10/2023 Conrad

(56) References Cited

U.S. PATENT DOCUMENTS

| | | | | |
|---|---|---|---|---|
| 11,839,343 | B2 | 12/2023 | Conrad et al. | |
| 11,841,024 | B2 | 12/2023 | Conrad | |
| 11,857,142 | B2 | 1/2024 | Conrad | |
| 11,950,745 | B2 | 4/2024 | Conrad et al. | |
| 12,053,143 | B2 | 8/2024 | Conrad | |
| 12,075,966 | B2 | 9/2024 | Conrad | |
| 12,551,068 | B2 * | 2/2026 | Conrad | A47L 5/24 |
| 2001/0027587 | A1 | 10/2001 | Conrad et al. | |
| 2002/0162188 | A1 | 11/2002 | Harmen | |
| 2003/0201754 | A1 | 10/2003 | Conrad | |
| 2004/0216264 | A1 | 11/2004 | Shaver et al. | |
| 2004/0216266 | A1 | 11/2004 | Conrad | |
| 2005/0081321 | A1 | 4/2005 | Milligan et al. | |
| 2005/0132528 | A1 | 6/2005 | Yau | |
| 2006/0090290 | A1 | 5/2006 | Lau | |
| 2006/0156508 | A1 | 7/2006 | Khalil | |
| 2006/0196004 | A1 | 9/2006 | Conrad | |
| 2006/0288516 | A1 | 12/2006 | Sawalski | |
| 2007/0033765 | A1 | 2/2007 | Walker et al. | |
| 2007/0271724 | A1 | 11/2007 | Hakan et al. | |
| 2008/0172992 | A1 | 7/2008 | Conrad | |
| 2008/0178416 | A1 | 7/2008 | Conrad | |
| 2008/0178418 | A1 | 7/2008 | Conrad | |
| 2008/0179133 | A1 | 7/2008 | Conrad | |
| 2008/0196366 | A1 | 8/2008 | Conrad | |
| 2008/0216281 | A1 | 9/2008 | Conrad | |
| 2009/0265877 | A1 | 10/2009 | Dyson et al. | |
| 2009/0282639 | A1 | 11/2009 | Dyson et al. | |
| 2009/0307863 | A1 | 12/2009 | Milne et al. | |
| 2009/0307864 | A1 | 12/2009 | Dyson | |
| 2009/0308254 | A1 | 12/2009 | Oakham | |
| 2009/0313958 | A1 | 12/2009 | Gomiciaga-Pereda et al. | |
| 2009/0313959 | A1 | 12/2009 | Gomiciaga-Pereda et al. | |
| 2010/0045215 | A1 | 2/2010 | Hawker et al. | |
| 2010/0175217 | A1 | 7/2010 | Conrad | |
| 2010/0229321 | A1 | 9/2010 | Dyson et al. | |
| 2010/0229323 | A1 | 9/2010 | Conrad | |
| 2010/0229324 | A1 | 9/2010 | Conrad | |
| 2010/0229325 | A1 | 9/2010 | Conrad | |
| 2010/0229326 | A1 | 9/2010 | Conrad | |
| 2010/0229328 | A1 | 9/2010 | Conrad | |
| 2010/0229334 | A1 | 9/2010 | Conrad | |
| 2010/0229335 | A1 | 9/2010 | Conrad | |
| 2010/0251507 | A1 | 10/2010 | Conrad | |
| 2011/0219567 | A1 | 9/2011 | Conrad | |
| 2011/0219576 | A1 | 9/2011 | Conrad | |
| 2011/0219579 | A1 | 9/2011 | Conrad | |
| 2012/0079671 | A1 | 4/2012 | Stickney et al. | |
| 2013/0091654 | A1 | 4/2013 | Smith | |
| 2013/0091656 | A1 | 4/2013 | Smith | |
| 2013/0091657 | A1 | 4/2013 | Smith | |
| 2013/0091658 | A1 | 4/2013 | Smith | |
| 2013/0091810 | A1 | 4/2013 | Smith | |
| 2013/0091812 | A1 | 4/2013 | Smith | |
| 2013/0091813 | A1 | 4/2013 | Smith | |
| 2013/0091814 | A1 | 4/2013 | Smith | |
| 2014/0137364 | A1 | 5/2014 | Stickney et al. | |
| 2014/0208538 | A1 | 7/2014 | Visel et al. | |
| 2014/0237768 | A1 | 8/2014 | Conrad | |
| 2015/0230677 | A1 | 8/2015 | Andrikanish | |
| 2016/0174794 | A1 * | 6/2016 | Conrad | A47L 5/30 15/347 |
| 2017/0188763 | A1 | 7/2017 | Hu | |
| 2017/0196419 | A1 | 7/2017 | Brown et al. | |
| 2017/0196420 | A1 | 7/2017 | Brown et al. | |
| 2017/0196421 | A1 | 7/2017 | Brown et al. | |
| 2017/0196423 | A1 | 7/2017 | Brown et al. | |
| 2017/0196424 | A1 | 7/2017 | Brown et al. | |
| 2017/0196425 | A1 | 7/2017 | Brown et al. | |
| 2017/0196426 | A1 | 7/2017 | Brown et al. | |
| 2017/0196427 | A1 | 7/2017 | Brown et al. | |
| 2017/0196428 | A1 | 7/2017 | Brown et al. | |
| 2017/0196429 | A1 | 7/2017 | Brown et al. | |
| 2017/0215664 | A1 | 8/2017 | Conrad et al. | |
| 2017/0290476 | A1 | 10/2017 | Conrad | |
| 2017/0290478 | A1 | 10/2017 | Conrad | |
| 2017/0290480 | A1 | 10/2017 | Conrad | |
| 2019/0008342 | A1 * | 1/2019 | Conrad | A47L 9/2889 |
| 2019/0104904 | A1 | 4/2019 | Song et al. | |
| 2019/0254491 | A1 * | 8/2019 | Conrad | A47L 9/322 |
| 2019/0254492 | A1 * | 8/2019 | Conrad | A47L 9/242 |
| 2019/0261824 | A1 * | 8/2019 | Conrad | A47L 5/365 |
| 2019/0343356 | A1 | 11/2019 | Kim et al. | |
| 2020/0163504 | A1 | 5/2020 | Conrad | |
| 2020/0253437 | A1 | 8/2020 | Conrad et al. | |
| 2020/0305671 | A1 | 10/2020 | Conrad | |
| 2021/0145233 | A1 | 5/2021 | Conrad | |
| 2021/0228032 | A1 * | 7/2021 | Conrad | A47L 5/225 |
| 2021/0290011 | A1 | 9/2021 | Conrad | |
| 2021/0330147 | A1 * | 10/2021 | Conrad | A47L 9/165 |
| 2021/0330157 | A1 | 10/2021 | Conrad | |
| 2021/0386258 | A1 | 12/2021 | Conrad | |
| 2022/0142424 | A1 | 5/2022 | Bradley | |
| 2022/0142440 | A1 | 5/2022 | Conrad | |
| 2022/0151446 | A1 | 5/2022 | Conrad et al. | |
| 2023/0017024 | A1 | 1/2023 | Conrad | |
| 2023/0098664 | A1 | 3/2023 | Conrad | |
| 2023/0263350 | A1 | 8/2023 | Conrad et al. | |
| 2023/0348169 | A1 | 11/2023 | Conrad | |
| 2024/0008701 | A1 | 1/2024 | Conrad et al. | |
| 2024/0016351 | A1 | 1/2024 | Conrad | |
| 2024/0041284 | A1 | 2/2024 | Conrad | |
| 2024/0081588 | A1 | 3/2024 | Conrad | |
| 2024/0138634 | A1 | 5/2024 | Conrad | |
| 2024/0172909 | A1 | 5/2024 | Conrad | |
| 2024/0180373 | A1 * | 6/2024 | Conrad | A47L 5/225 |
| 2024/0180379 | A1 | 6/2024 | Conrad | |
| 2024/0245271 | A1 | 7/2024 | Conrad | |
| 2024/0260799 | A1 * | 8/2024 | Conrad | A47L 5/225 |
| 2024/0335077 | A1 | 10/2024 | Conrad | |
| 2024/0358212 | A1 | 10/2024 | Conrad | |
| 2024/0382056 | A1 | 11/2024 | Conrad | |
| 2026/0033678 | A1 * | 2/2026 | Conrad | A47L 5/225 |
| 2026/0053314 | A1 * | 2/2026 | Conrad | A47L 9/1608 |

FOREIGN PATENT DOCUMENTS

| | | | |
|---|---|---|---|
| CA | 2258416 | A1 | 7/2000 |
| CA | 2258419 | A1 | 7/2000 |
| CA | 2258421 | A1 | 7/2000 |
| CA | 2258422 | A1 | 7/2000 |
| CA | 2258423 | A1 | 7/2000 |
| CA | 2258426 | A1 | 7/2000 |
| CA | 2330801 | A1 | 7/2001 |
| CA | 2338193 | A1 | 7/2002 |
| CA | 2339514 | A1 | 9/2002 |
| CA | 2342673 | A1 | 9/2002 |
| CA | 2342993 | A1 | 9/2002 |
| CA | 2484587 | A1 | 4/2005 |
| CA | 2658014 | A1 | 9/2010 |
| CA | 2658022 | A1 | 9/2010 |
| CA | 2658160 | A1 | 9/2010 |
| CA | 2658366 | A1 | 9/2010 |
| CA | 2658397 | A1 | 9/2010 |
| CA | 2658497 | A1 | 9/2010 |
| CA | 2658643 | A1 | 9/2010 |
| CA | 2658644 | A1 | 9/2010 |
| CA | 2484587 | C | 1/2011 |
| CA | 2730437 | A1 | 9/2011 |
| CN | 1895148 | A | 1/2007 |
| CN | 1911151 | A | 2/2007 |
| CN | 101061932 | A | 10/2007 |
| CN | 101095604 | A | 1/2008 |
| CN | 101448447 | A | 6/2009 |
| CN | 101489453 | A | 7/2009 |
| CN | 101489455 | A | 7/2009 |
| CN | 101489457 | A | 7/2009 |
| CN | 101489461 | A | 7/2009 |
| CN | 101822506 | A | 9/2010 |
| CN | 201683850 | U | 12/2010 |
| CN | 1911151 | B | 4/2011 |
| CN | 102188208 | A | 9/2011 |
| CN | 102256523 | A | 11/2011 |
| CN | 202173358 | U | 3/2012 |

(56) References Cited

FOREIGN PATENT DOCUMENTS

| | | | |
|---|---|---|---|
| CN | 101489455 | B | 6/2012 |
| CN | 101489457 | B | 6/2012 |
| CN | 202739907 | U | 2/2013 |
| CN | 202932850 | U | 5/2013 |
| CN | 103169420 | A | 6/2013 |
| CN | 203724037 | U | 7/2014 |
| CN | 102256523 | B | 11/2014 |
| CN | 203914775 | U | 11/2014 |
| CN | 104172986 | A | 12/2014 |
| CN | 204016180 | U | 12/2014 |
| CN | 204363891 | U | 6/2015 |
| CN | 204581145 | U | 8/2015 |
| CN | 205671986 | U | 11/2016 |
| CN | 107260059 | A | 10/2017 |
| CN | 109330475 | A | 2/2019 |
| CN | 209003800 | U | 6/2019 |
| CN | 209153419 | U | 7/2019 |
| CN | 209391852 | U | 9/2019 |
| CN | 210989962 | U | 7/2020 |
| CN | 113907637 | A | 1/2022 |
| CN | 218044931 | U | 12/2022 |
| DE | 112010001135 | T5 | 8/2012 |
| EP | 100438 | A2 | 2/1984 |
| EP | 1594386 | B1 | 4/2009 |
| EP | 2308360 | A2 | 4/2011 |
| EP | 2581013 | A1 | 4/2013 |
| EP | 2308360 | B1 | 6/2015 |
| GB | 2440111 | A | 1/2008 |
| GB | 2441962 | B | 3/2011 |
| GB | 2508035 | A | 5/2014 |
| GB | 2508035 | B | 3/2015 |
| JP | 2008206613 | A | 9/2008 |
| JP | 2010178773 | A | 8/2010 |
| JP | 2010220632 | A | 10/2010 |
| JP | 2011189133 | A | 9/2011 |
| WO | 0010718 | A1 | 3/2000 |
| WO | 2004069021 | A1 | 8/2004 |
| WO | 2006076363 | A2 | 7/2006 |
| WO | 2008009883 | A1 | 1/2008 |
| WO | 2008009888 | A1 | 1/2008 |
| WO | 2008009890 | A1 | 1/2008 |
| WO | 2008009891 | A1 | 1/2008 |
| WO | 2008035032 | A2 | 3/2008 |
| WO | 2010102396 | A1 | 9/2010 |
| WO | 2010147247 | A1 | 12/2010 |
| WO | 2012042240 | A1 | 4/2012 |
| WO | 2016065151 | A1 | 4/2016 |
| WO | 2016173466 | A1 | 11/2016 |
| WO | 2017046557 | A1 | 3/2017 |
| WO | 2017046560 | A1 | 3/2017 |
| WO | 2021097556 | A1 | 5/2021 |

OTHER PUBLICATIONS

U.S. Appl. No. 18/590,937, filed Feb. 28, 2024.
U.S. Appl. No. 18/596,575, filed Mar. 5, 2024.
U.S. Appl. No. 18/585,983, filed Feb. 23, 2024.
U.S. Appl. No. 18/590,658, filed Feb. 28, 2024.
English machine translation of WO2016173466A1, published on Nov. 3, 2016.
English machine translation of JP2010178773A, published on Aug. 19, 2010.
English machine translation of DE112010001135T5, published on Aug. 2, 2012.
English machine translation of CN102256523A, published on Nov. 23, 2011.
English machine translation of CN1911151A, published on Feb. 14, 2007.
English machine translation of CN101095604A, published on Jan. 2, 2008.
English machine translation of CN101489457A, published on Jul. 22, 2009.
English machine translation of CN101489453A, published on Jul. 22, 2009.
English machine translation of CN1895148A, published on Jan. 17, 2007.
English machine translation of JP2010220632A, published on Oct. 7, 2010.
English machine translation of CN101822506A, published on Sep. 8, 2010.
English machine translation of CN102188208A, published on Sep. 21, 2011.
International Search Report and Written Opinion, received in connection to International Patent Application No. PCT/CA2024/051237, mailed on Dec. 20, 2024.
English machine translation of CN201683850U, published on Dec. 29, 2010.
English machine translation of CN1911151B, published on Apr. 13, 2011.
English machine translation of CN202173358U, published on Mar. 28, 2012.
English machine translation of CN101489455B, published on Jun. 27, 2012.
English machine translation of CN101489457B, published on Jun. 27, 2012.
English machine translation of CN202739907U, published on Feb. 20, 2013.
English machine translation of CN202932850U, published on May 15, 2013.
English machine translation of CN203724037U , published on Jul. 23, 2014.
English machine translation of CN102256523B, published on Nov. 5, 2014.
English machine translation of CN203914775U , published on Nov. 5, 2014.
English machine translation of CN204016180U , published on Dec. 17, 2014.
English machine translation of CN204363891U, published on Jun. 3, 2015.
English machine translation of CN204581145U , published on Aug. 26, 2015.
English machine translation of CN205671986U, published on Nov. 9, 2016.
English machine translation of JP2011189133A, published on Sep. 29, 2011.
English machine translation of CN103169420A, published on Jun. 26, 2013.
English machine translation of CN101489455A, published on Jul. 22, 2009.
English machine translation of CN101061932A , published on Oct. 31, 2007.
English machine translation of CN104172986A , published on Dec. 3, 2014.
English machine translation of CN101448447A, published on Jun. 3, 2009.
English machine translation of CN101489461A, published on Jul. 22, 2009.
English machine translation of JP2008206613A, published on Sep. 11, 2008.
International Search Report and Written Opinion, received in connection to United States Patent Application No. PCT/CA2025/050300, mailed on Apr. 28, 2025.

* cited by examiner

SURFACE CLEANING APPARATUS

FIELD

This disclosure relates generally to portable surface cleaning apparatuses such as hand vacuum cleaners.

INTRODUCTION

The following is not an admission that anything discussed below is part of the prior art or part of the common general knowledge of a person skilled in the art.

Various types of surface cleaning apparatus are known, including upright surface cleaning apparatus, canister surface cleaning apparatus, stick surface cleaning apparatus, central vacuum systems, and hand carriable surface cleaning apparatus such as hand vacuum cleaners. Further, various designs for cyclonic surface cleaning apparatus, including battery operated cyclonic hand vacuum cleaners are known in the art.

SUMMARY

This summary is intended to introduce the reader to the more detailed description that follows and not to limit or define any claimed or as yet unclaimed invention. One or more inventions may reside in any combination or sub-combination of the elements or process steps disclosed in any part of this document including its claims and figures.

In accordance with one aspect of this disclosure, a hand vacuum cleaner which is operable using an energy storage member unit (e.g., a pack which contains one or more energy storage members such as one or more batteries, capacitors or the like). When the hand vacuum cleaner is ready for use, the energy storage member unit is at least partially located within the handle of the hand vacuum cleaner and in the main body of the hand vacuum cleaner. An advantage of this aspect is that larger batteries and/or more powerful batteries may be provided compactly within the vacuum cleaner while providing a hand vacuum cleaner with good weight distribution. Accordingly, the vacuum cleaner may be more powerful and/or have a longer run time. Optionally, the energy storage member unit may be in the airflow path. Optionally, the energy storage member unit is removable.

In accordance with this aspect of this disclosure, there is provided a hand vacuum cleaner comprising:

(a) an airflow path from a dirty air inlet positioned at a front end of the hand vacuum cleaner to a clean air outlet positioned rearward of the dirty air inlet;

(b) an air treatment assembly comprising an air treatment chamber, the air treatment chamber positioned in the airflow path, the air treatment chamber has an air treatment chamber air inlet, an air treatment chamber air outlet, a front end, a rear end and a centrally positioned longitudinal axis extending between the front and rear ends of the air treatment chamber;

(c) a main body housing a motor and fan assembly that is positioned in the air flow path, the motor and fan assembly having a motor axis of rotation;

(d) a handle extending away from the main body; and, (e) an energy storage member unit, wherein a first portion of the energy storage member unit is provided in the handle and a second portion of the energy storage member unit is provided in the main body.

In accordance with this aspect of this disclosure, there is also provided a hand vacuum cleaner comprising:

(a) an airflow path from a dirty air inlet positioned at a front end of the hand vacuum cleaner to a clean air outlet positioned rearward of the dirty air inlet;

(b) an air treatment assembly comprising an air treatment chamber, the air treatment chamber positioned in the airflow path, the air treatment chamber has an air treatment chamber air inlet, an air treatment chamber air outlet, a front end, a rear end and a centrally positioned longitudinal axis extending between the front and rear ends of the air treatment chamber;

(c) a main body housing a motor and fan assembly that is positioned in the air flow path, the motor and fan assembly having a motor axis of rotation;

(d) a handle having a first end, an opposed second end, a hand grip portion positioned between the first end and the opposed second end of the handle and a handle axis that extends through the hand grip portion from the first end to the opposed second end; and, (e) an energy storage member unit comprising a plurality of energy storage members that have a length, which is a longest dimension of the energy storage member, and in use the length extends in a direction of the handle axis, wherein, in use, the motor axis of rotation intersects the energy storage member unit and the motor and fan assembly is located rearward of at least one of the energy storage members.

In accordance with this aspect sure, there is also provided a hand vacuum cleaning comprising:

(a) an airflow path from a dirty air inlet positioned at a front end of the hand vacuum cleaner to a clean air outlet positioned rearward of the dirty air inlet;

(b) an air treatment assembly comprising an air treatment chamber, the air treatment chamber positioned in the airflow path, the air treatment chamber has an air treatment chamber air inlet, an air treatment chamber air outlet, a front end, a rear end and a longitudinal axis that extends between the front and rear ends of the air treatment chamber;

(c) a main body housing a motor and fan assembly that is positioned in the air flow path, the motor and fan assembly having a motor axis of rotation;

(d) a handle having a first end, an opposed second end, a hand grip portion positioned between the first end and the opposed second end of the handle and a handle axis that extends through the hand grip portion from the first end to the opposed second end; and, (e) an energy storage member unit comprising a plurality of energy storage members that have a length, which is a longest dimension of the energy storage member, and in use the length extends in a direction of the handle axis, wherein, in use, the longitudinal axis intersects the energy storage member unit and the motor and fan assembly is located rearward of at least one of the energy storage members.

In accordance with another aspect of the disclosure, a hand vacuum cleaner has a handle, which may be a pistol grip handle. An energy storage member unit may be insertable into the handle and optionally, also into the main body of the hand vacuum cleaner, through a lower end of the handle. The handle may have an open lower end and the energy storage member unit may optionally close the lower end of the handle. Alternately, the lower end of the handle may have an openable door which, when opened, enable the energy storage member unit to be installed or removed.

In accordance with this aspect, there is provided a hand vacuum cleaner comprising:

(a) an airflow path from a dirty air inlet positioned at a front end of the hand vacuum cleaner to a clean air outlet positioned rearward of the dirty air inlet;

(b) an air treatment assembly comprising an air treatment chamber, the air treatment chamber positioned in the airflow path, the air treatment chamber has an air treatment chamber air inlet, an air treatment chamber air outlet, a front end, a rear end and a centrally positioned longitudinal axis extending between the front and rear ends of the air treatment chamber;

(c) a main body housing a motor and fan assembly that is positioned in the air flow path, the motor and fan assembly having a motor axis of rotation;

(d) a handle extending away from the main body; and, (e) an energy storage member unit that is removably insertable into the handle.

It will be appreciated by a person skilled in the art that an apparatus or method disclosed herein may embody any one or more of the features contained herein and that the features may be used in any particular combination or sub-combination.

These and other aspects and features of various embodiments will be described in greater detail below.

BRIEF DESCRIPTION OF THE DRAWINGS

For a better understanding of the described embodiments and to show more clearly how they may be carried into effect, reference will now be made, by way of example, to the accompanying drawings in which.

Figure 1A:
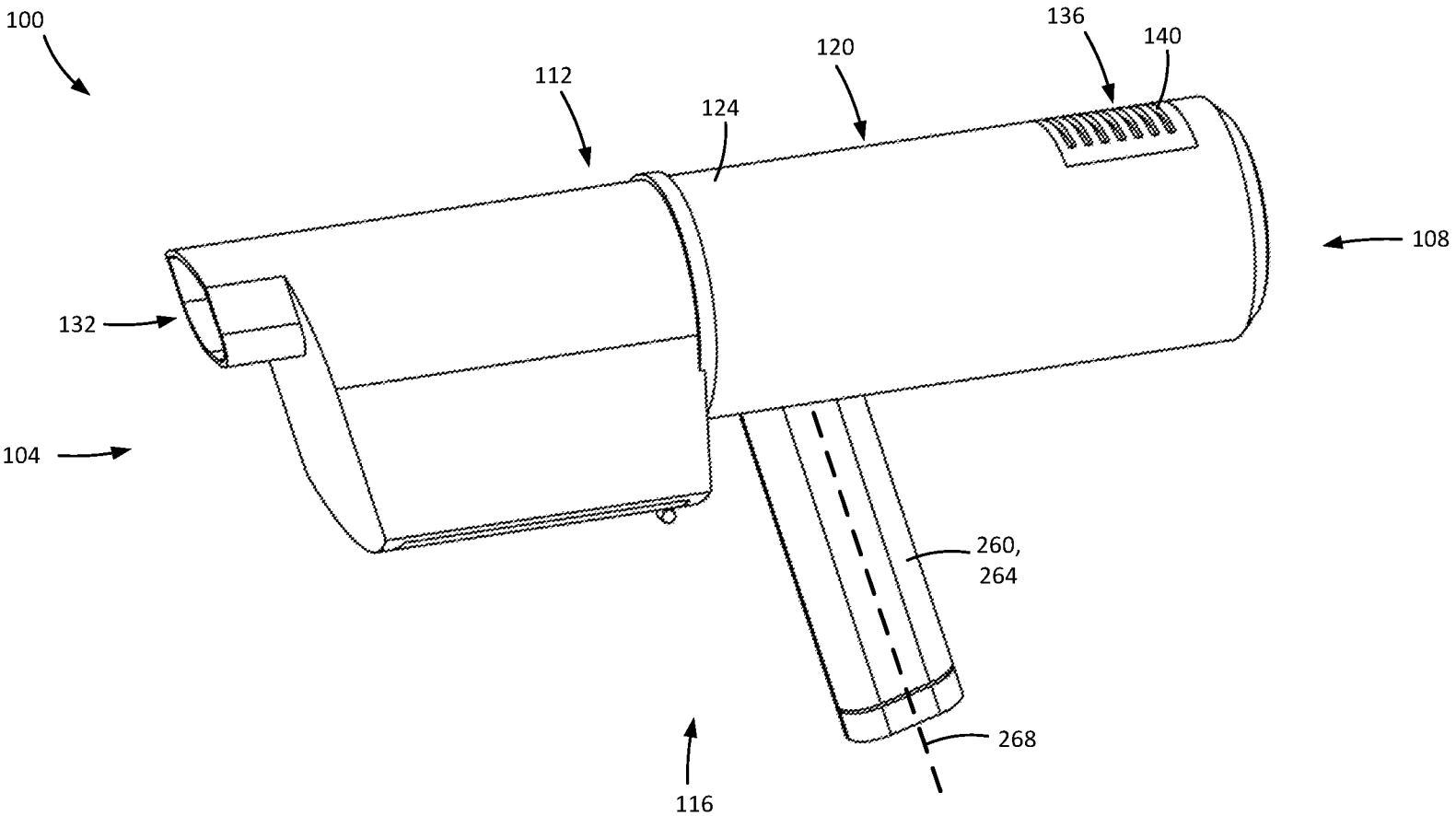
FIG. 1A is a side perspective view of a surface cleaning apparatus.

The drawings included herewith are for illustrating various examples of articles, methods, and apparatuses of the teaching of the present specification and are not intended to limit the scope of what is taught in any way.

DESCRIPTION OF VARIOUS EMBODIMENTS

Various apparatuses will be described below to provide an example of an embodiment of each claimed invention. No embodiment described below limits any claimed invention and any claimed invention may cover apparatuses that differ from those described below. The claimed inventions are not limited to apparatuses having all of the features of any one apparatus described below or to features common to multiple or all of the apparatuses described below. It is possible that an apparatus described below is not an embodiment of any claimed invention. Any invention disclosed in an apparatus described below that is not claimed in this document may be the subject matter of another protective instrument, for example, a continuing patent application, and the applicants, inventors or owners do not intend to abandon, disclaim or dedicate to the public any such invention by its disclosure in this document.

The terms "an embodiment", "embodiment", "embodiments", "the embodiment", "the embodiments", "one or more embodiments", "some embodiments", and "one embodiment" mean "one or more (but not all) embodiments of the present invention(s), "unless expressly specified otherwise.

The terms "including", "comprising", and variations thereof mean "including but not limited to", unless expressly specified otherwise. A listing of items does not imply that any or all of the items are mutually exclusive, unless expressly specified otherwise. The terms "a", "an", and "the" mean "one or more", unless expressly specified otherwise.

As used herein and in the claims, two or more parts are said to be "coupled", "connected", "attached", or "fastened" where the parts are joined or operate together either directly or indirectly (i.e., through one or more intermediate parts), so long as a link occurs. As used herein and in the claims, two or more parts are said to be "directly coupled", "directly connected", "directly attached", or "directly fastened" where the parts are connected in physical contact with each other. As used herein, two or more parts are said to be "rigidly coupled", "rigidly connected", "rigidly attached", or "rigidly fastened" where the parts are coupled so as to move as one while maintaining a constant orientation relative to each other. None of the terms "coupled", "connected", "attached", and "fastened" distinguish the manner in which two or more parts are joined together.

Some elements herein may be identified by a part number, which is composed of a base number followed by an alphabetical or subscript-numerical suffix (e.g., 112*a*, or 1121). Multiple elements herein may be identified by part numbers that share a base number in common and that differ by their suffixes (e.g., 1121, 1122, and 1123). All elements with a common base number may be referred to collectively or generically using the base number without a suffix (e.g., 112).

It should be noted that terms of degree such as "substantially", "about", and "approximately" as used herein mean a reasonable amount of deviation of the modified term such that the end result is not significantly changed. These terms of degree may also be construed as including a deviation of the modified term, such as by 1%, 2%, 5% or 10%, for example, if this deviation does not negate the meaning of the term it modifies.

Furthermore, the recitation of numerical ranges by endpoints herein includes all numbers and fractions subsumed within that range (e.g., 1 to 5 includes 1, 1.5, 2, 2.75, 3, 3.90, 4, and 5). It is also to be understood that all numbers and fractions thereof are presumed to be modified by the term "about" which means a variation of up to a certain amount of the number to which reference is being made if the end result is not significantly changed, such as 1%, 2%, 5%, or 10%, for example.

General Description of a Surface Cleaning Apparatus

Referring to the Figures, exemplary embodiments of surface cleaning apparatuses 100 are shown. The following is a general discussion of surface cleaning apparatuses 100 which provides a basis for understanding several of the features which are discussed herein. As discussed subsequently, each of the features may be used individually or in any particular combination or sub-combination in this or in other embodiments disclosed herein.

In the embodiments illustrated, the surface cleaning apparatus 100 is a hand-held vacuum cleaner, which is commonly referred to as a "hand vacuum cleaner" or a "handvac". As used herein, a hand-held vacuum cleaner or hand vacuum cleaner or handvac is a vacuum cleaner that can be operated generally one-handedly to clean a surface while its weight is held by the same one hand. This is contrasted with upright and canister vacuum cleaners, the weight of which is supported by a surface (e.g. floor below) during use. Optionally, surface cleaning apparatus 100 could be removably mountable on a base so as to form part of, for example, an upright vacuum cleaner, a canister vacuum cleaner, a stick vac, a wet-dry vacuum cleaner and the like.

It will also be appreciated that a surface cleaning apparatus may use any configuration of the operating components and the airflow paths exemplified herein.

Referring to FIG. 1A, a hand surface cleaning apparatus is exemplified as a hand vacuum cleaner with an apparatus front end 104, an apparatus rear end 108, an apparatus upper end 112 and an apparatus lower end 116. The surface cleaning apparatus 100 includes a main body 120. The main body 120 includes a main body housing 124.

An apparatus air flow path 128 (see, e.g., FIGS. 1B-1C) extends from an apparatus dirty air inlet 132 to an apparatus clean air outlet 136. The apparatus dirty air inlet 132 may be provided at the apparatus front end 104. The apparatus dirty air inlet 132 may be at an uppermost part of the front end 104 as exemplified, and may be directed forwardly as exemplified (i.e., opening forwardly). It will be appreciated that the dirty air inlet 132 may be located elsewhere, such as a lowermost part of the apparatus front end 104.

The apparatus clean air outlet 136 is located rearward of the dirty air inlet 132 and may be provided at the apparatus upper end 112. The apparatus clean air outlet 136 may be at a rearmost part of the upper end 112. It will be appreciated that the clean air outlet 136 may be located elsewhere, such as at other locations along the upper end 112, or at the apparatus lower or rear ends 116, 108. It will also be appreciated that clean air outlet 136 may include multiple openings at different locations (e.g., on each lateral side of the surface cleaning apparatus 100). As exemplified in FIG. 1A, the clean air outlet 136 is provided as part of the main body 120 and includes a grill 140. The clean air outlet 136 may be in other configurations, shapes, and/or positions in other embodiments.

Figure 1B:
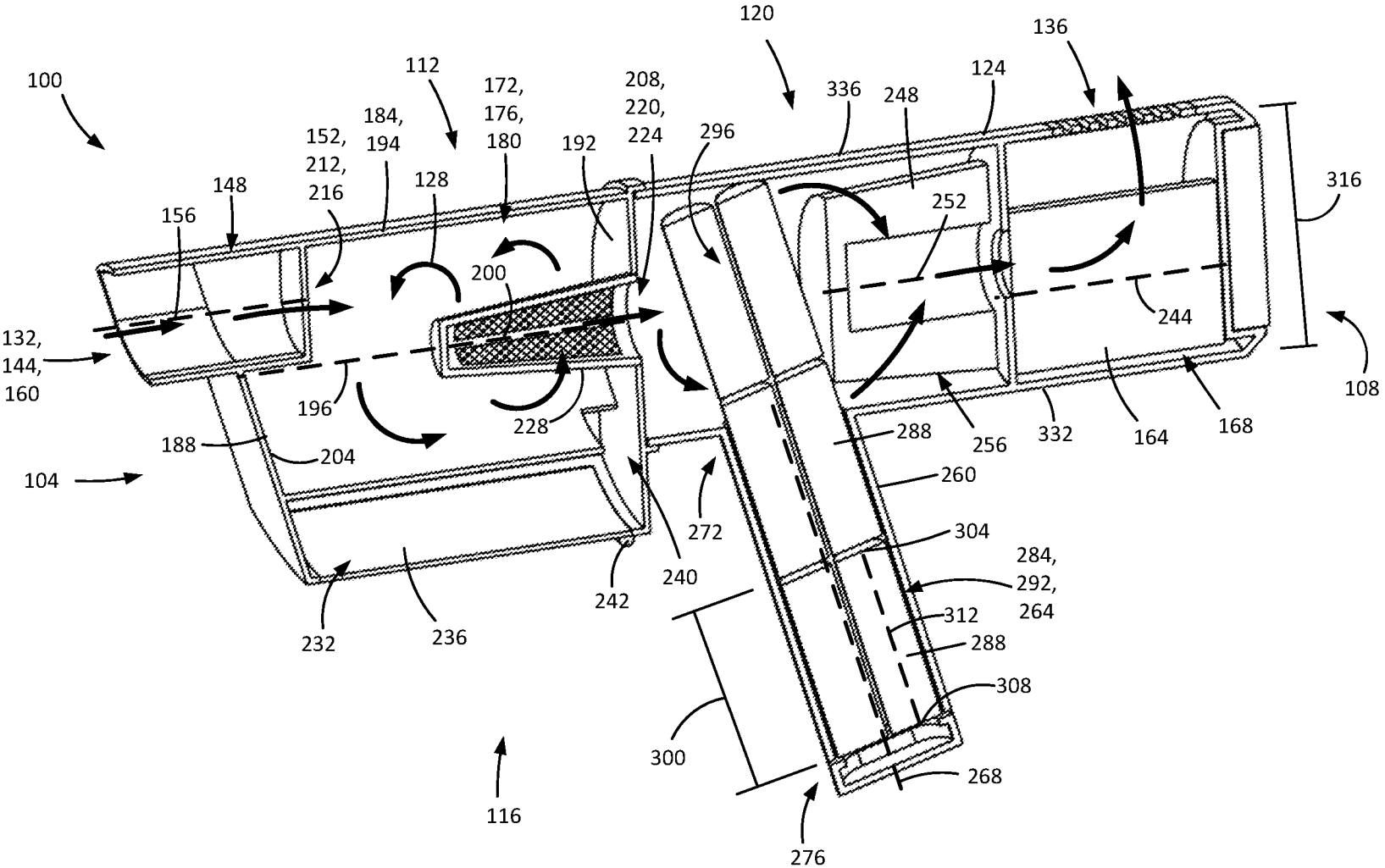
FIG. 1B is a cross-sectional side perspective view taken in a vertical plane extending through the lateral center of the cyclone air outlet of the surface cleaning apparatus of FIG. 1A.
Figure 1C:
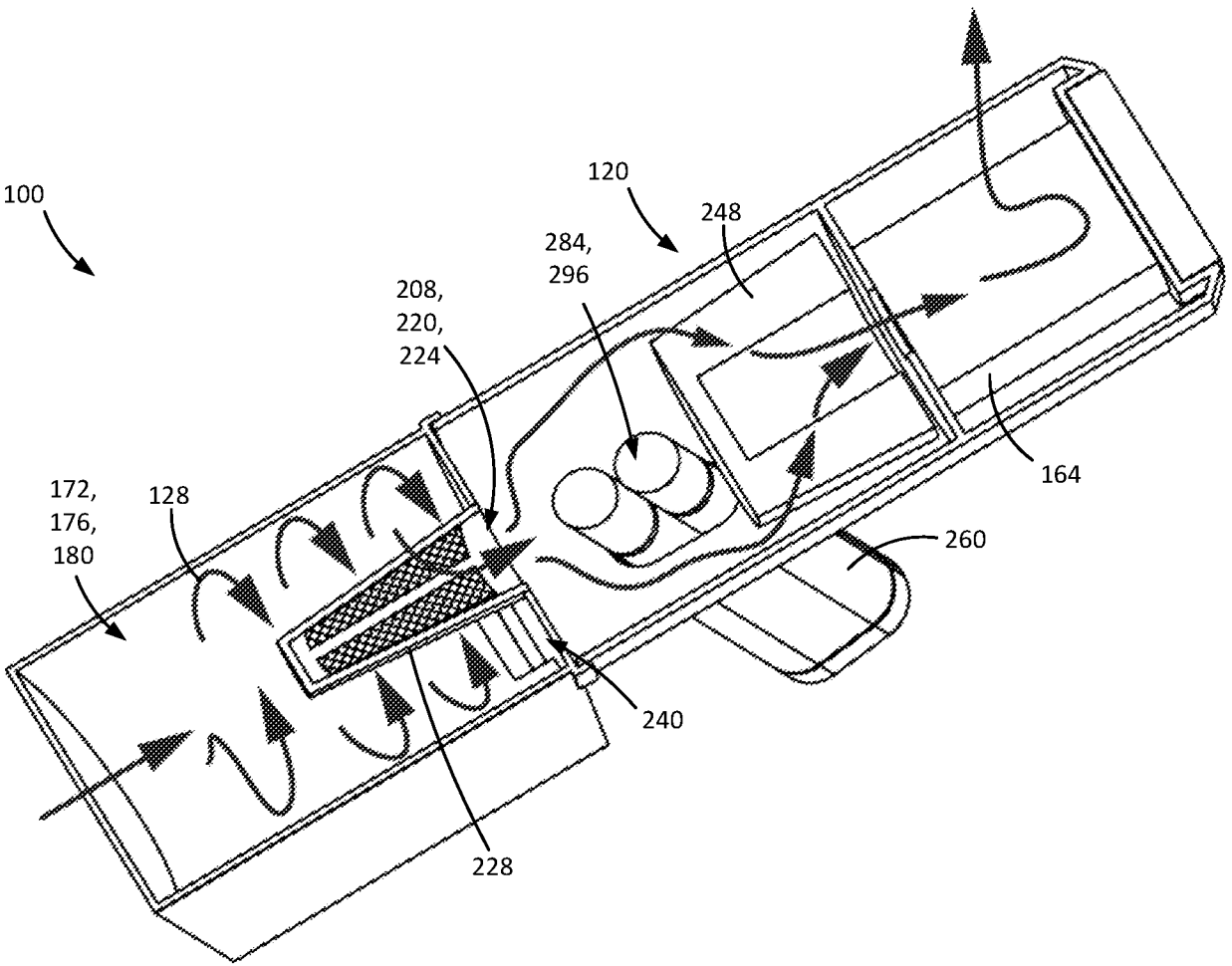
FIG. 1C is a cross-sectional top perspective view taken in a horizontal plane that extends through the vertical center of the cyclone air outlet of the surface cleaning apparatus of FIG. 1A.

Referring to FIG. 1B, the apparatus dirty air inlet 132 may be provided at an inlet end 144 of an inlet conduit 148. The inlet conduit 148 extends from the apparatus dirty air inlet 132 rearwardly to an inlet conduit outlet end 152. Optionally, as exemplified, the inlet conduit outlet end 152 is within an internal air treatment chamber of the surface cleaning apparatus 100 (e.g., an air treatment chamber 180 which may be a cyclone chamber, described further below). Accordingly, the inlet conduit 148 may be position in the air treatment chamber 180. Alternatively, the inlet conduit 148 may be provided external to the internal chamber (e.g., the inlet conduit may extend rearwardly along an upper or lower end of the air treatment chamber 180 and may have an outlet port that is also an inlet port provided in a sidewall (e.g., a sidewall) of the air treatment chamber 180.

It will also be appreciated that, in some embodiments, the surface cleaning apparatus 100 may not include an inlet conduit 148, and the apparatus dirty air inlet 132 may instead open directly into a downstream chamber (e.g., the air treatment chamber 180) rather than being at an upstream end of a conduit.

The inlet conduit 148 may be a generally linear conduit having an inlet conduit longitudinal axis 156 along a longest dimension of the inlet conduit and extending between the inlet conduit inlet end 144 and the inlet conduit outlet end 152. The inlet conduit longitudinal axis 156 may be generally horizontal when the apparatus upper end 112 is above the apparatus lower end 116.

As exemplified, the inlet conduit 148 may form a nozzle 160 of the surface cleaning apparatus 100. Alternatively, or additionally, the inlet conduit 148 may be connected or directly connected to an accessory. The accessory may be any suitable accessory tool such as a rigid air flow conduit which may include or be connectable to a surface cleaning head to form a stick vacuum cleaner, a crevice tool, a mini brush, and the like. The accessory may be coupled to the surface cleaning apparatus 100 such that the accessory is in air flow communication with the dirty air inlet 132 (e.g., in air flow communication with the inlet conduit 148). For example, the accessory may be or include a conduit, and the conduit of the accessory may be received within the inlet conduit 148 or may receive the inlet conduit 148 within the accessory conduit. Optionally, one or more releasable fasteners may be used to couple the accessory to the surface cleaning apparatus 100, such as inter-engagement members or magnets. Alternatively, or additionally, the accessory may be held in air flow communication with the dirty air inlet 132 via a friction fit (e.g., between an outer diameter of an accessory conduit and an inner diameter of the inlet conduit 148, or vice versa).

As exemplified herein, the surface cleaning apparatus 100 includes an air treatment assembly 172. The apparatus air flow path 128 extends through the air treatment assembly 172. The air treatment assembly 172 is configured to remove particles of dirt and other debris from the airflow and/or otherwise treat the airflow. The air treatment assembly 172 includes one or more air treatment members 176. Any air treatment member or members known in the art may be used. For example, the surface cleaning apparatus may use one or more cyclones, non-cyclonic momentum separators, bags, screens, physical filter media (e.g., foam, felt, HEPA) or the like.

It will be appreciated that the air treatment assembly 172 may include any suitable number of air treatment stages, each with any suitable number of air treatment members in parallel. For example, the air treatment member 176 may include a first separation stage with a single air treatment member or chamber (e.g., a cyclone or non-cyclonic momentum separator) and a downstream second stage comprising a plurality of air treatment members or chambers (e.g., an array of cyclones in parallel with one another). As exemplified herein, the air treatment assembly 172 may comprise a single cleaning stage. A single cleaning stage may include, e.g., a single cyclonic stage (which may comprise one or more cyclones in parallel), or a single non-cyclonic momentum separator chamber. As exemplified, the single cleaning stage has a single air treatment member which is a single cyclone chamber, and, as such, the air treatment assembly 172 may be referred to as air treatment member 176.

The exemplary air treatment member 176 includes an air treatment chamber 180. The air treatment chamber 180 has a chamber housing 184 having a chamber first end wall 188 and a chamber second end wall 192 axially spaced from the chamber first end wall 188 along a centrally positioned chamber longitudinal axis 196. The chamber first end wall 188 and chamber second end wall 192 may close the ends of the air treatment chamber 180. The chamber first end wall 188 may be or comprise a front end of the chamber 180 and the chamber second end wall 196 may be comprise a rear end of the chamber 180. The chamber housing 184 also has a chamber sidewall 194 that extends between the chamber first end wall 188 and chamber second end wall 192. The air treatment chamber 180 may be a cyclone chamber, as exemplified, and the chamber longitudinal axis 196 may be a cyclone axis of rotation. The chamber longitudinal axis 196 may be a generally horizontal axis when the apparatus upper end 112 is above the apparatus lower end 116 and may extend between the apparatus front end 104 and the apparatus rear end 108.

An air treatment member longitudinal axis 200 extends between an air treatment member first end 204 (e.g., front end) and an air treatment member second end 208 (e.g., rear end). As exemplified, the air treatment member longitudinal axis 200 may be the same as the chamber longitudinal axis 196. As exemplified, the air treatment member longitudinal axis 200 may be centrally located within the air treatment chamber 180. The air treatment member longitudinal axis 200 may be generally horizontal when the apparatus upper end 112 is above the apparatus lower end 116.

The air treatment chamber 180 has an air treatment chamber air inlet 212 including a chamber inlet opening 216 and an air treatment chamber air outlet 220 including a chamber outlet opening or port 224. The apparatus air flow path 128 extends through the chamber inlet opening 216 and the chamber outlet opening or port 224. However, it will be appreciated that in some embodiments, the air treatment chamber air inlet 212 and/or the air treatment chamber air outlet 220 may include more than just an opening and may be at any location.

Optionally, as exemplified, the air treatment chamber air outlet 220 may include a screen which, if the chamber 180 is a cyclone, may be a vortex finder 228. The vortex finder 228 may overlies the air treatment chamber air outlet 220. As shown, the vortex finder 228 may extend inwardly into the air treatment chamber 180.

As exemplified, the air treatment assembly 172 may include a dirt collection region 232. As exemplified in FIG. 1B, the dirt collection region 232 may be external to the air treatment chamber 180 in a separate dirt collection chamber 236. The separate dirt collection chamber 236 may communicate with the air treatment chamber 180 via one or more dirt outlets 240 (e.g., an opening in a wall of the air treatment chamber 180 or a gap between walls of the air treatment chamber 180). Alternatively, the dirt collection region 232 may be an area of the air treatment chamber 180 (i.e., is internal to the air treatment chamber 180). The dirt collection region 232 may include, e.g., a forward portion of the air treatment chamber 180.

It will be appreciated that the air treatment assembly 172 may include any suitable number of discrete dirt collection regions 232. In some embodiments, the air treatment assembly 172 may include separate collection regions for fine dirt and for coarse dirt, or separate dirt outlets to a common dirt collection chamber for fine dirt and for coarse dirt. It will be understood that the air treatment chamber 180 and dirt collection region 232 may be of any configuration suitable for separating dirt from an air stream and collecting the separated dirt, respectively.

It will also be appreciated that the air treatment chamber 180 and/or dirt collection chamber 236 may be openable to, for example, allow for dirt removal. For example, part or all of chamber first end wall 188, chamber sidewall 194 or rear end wall 192 may be openable. For example, as shown in FIG. 1B, a portion of the chamber sidewall 194 is openable downwardly by pivoting the portion about a pivot joint 242.

A suction motor and fan assembly, which may be a suction motor 164, is provided to generate air flow through the air flow path 128, and is positioned within a motor housing 168. It will be appreciated that, instead of a clean air motor which is exemplified, a dirty air motor may be used The suction motor housing 168 may form part of the outer surface of the main body housing 124, or may be internal thereto. The suction motor housing 168 may be of any suitable construction, including any of those exemplified herein.

Optionally, as exemplified, the suction motor 164 is a clean air motor that is positioned downstream from the air treatment member 176 and rearward thereof. The suction motor 164 may be located at the apparatus rear end 108 as exemplified or at any location between the air treatment member 176 and the rear end 108. In addition, the suction motor 164 may be provided at any vertical elevation within the main body. As exemplified, the suction motor 164 may be located at the apparatus lower end 116. In other embodiments, the suction motor 164 may be located at the apparatus upper end 112. Air may travel rearwardly from the air treatment assembly 172 to the suction motor 164, and air flow direction between the air treatment member 176 and the suction motor 164 may have a rearward component at each point along the way.

The suction motor 164 rotates about a central motor axis of rotation 244. Optionally, when the apparatus upper end 112 is positioned above the apparatus lower end 116, the motor axis of rotation 244 is oriented generally horizontally and extends between the apparatus front end 104 and the apparatus rear end 108. In other examples, however, the motor axis of rotation 244 may extend at any angle to the horizontal, or it may extend vertically. Accordingly, the suction motor 244 may be oriented in any direction within the surface cleaning apparatus 100. Optionally, as exemplified, the motor axis of rotation 222 extends in a common direction with the cyclone axis of rotation and, optionally, they may be coaxial.

Optionally, one or more pre-motor filters 248 may be placed in the air flow path 128 downstream of the air treatment member 176 and upstream of the suction motor 164. Alternatively, or in addition, one or more post-motor filters (not shown) may be provided downstream from the suction motor 124 and upstream of the clean air outlet. The pre-motor filter 248 and the post-motor filter may be formed from any suitable physical, porous filter media and may have any suitable shape, including the examples disclosed herein. For example, the pre-motor filter 248 and/or the post-motor filter may be one or more of a foam filter, felt filter, HEPA filter, other physical filter media, electrostatic filter, and the like. Optionally, one or both of the pre-motor filter 248 and the post-motor filter includes a series of filter media, and, optionally, each downstream filter media has finer pores than the preceding upstream screen.

The pre-motor filter 248 may have any suitable shape and may be at any location. As exemplified, the pre-motor filter 248 may be configured as a generally cylindrical or frusto-conical foam filter with a hollow, open interior (e.g., FIG. 1B). Alternatively, the pre-motor filter 248 may be a generally flat, slab-like filter. The pre-motor filter 248 may have a longest dimension in a longitudinal (horizontal) direction along a pre-motor filter longitudinal axis 252. The pre-motor filter longitudinal axis 252 may be generally parallel to and/or coaxial with one or more of the air treatment member longitudinal axis 200, the motor axis of rotation 244, and the inlet conduit longitudinal axis 156.

The pre-motor filter 248 may be provided in a pre-motor filter housing 256. The pre-motor filter housing 256 may be of any suitable construction, including any of those exemplified herein. The pre-motor filter housing 256 may be openable or accessible to allow the pre-motor filter 248 to be cleaned and/or replaced. Optionally, the pre-motor filter 248 may be located at the rear end of the air treatment assembly and, if the air treatment assembly is removable, the pre-motor filter 248 may be accessible when the air treatment assembly is removed (e.g., an upstream face of a pre-motor filter seated in the main body may be revealed or accessible when the air treatment assembly is removed) or the downstream face of the pre-motor filter may be revealed or accessible (e.g., the pre-motor filter is seated in a rear end of the removable air treatment assembly) when the air treatment ember is removed. Similarly, if a rear end of the air treatment assembly is pivotally mounted, e.g., to the main body, a face of the pre-motor filter may be revealed or accessible when the air treatment assembly is pivoted open.

Optionally, a post-motor filter (not shown) may be placed in the air flow path 128 downstream of the suction motor 164 and upstream of apparatus clean air outlet 136. The post-motor filter may be provided in a post-motor filter housing, which may be part of the main body. The post-motor filter housing may be of any suitable construction. The post-motor filter may have various configurations, shapes and/or positions. For example, the post-motor filter may be located radially outwards of the suction motor 164. The post-motor filter may alternatively be sandwiched between the motor housing 168 and the main body housing 124.

In the embodiments disclosed herein, the surface cleaning apparatus 100 has a handle 260 (e.g., FIG. 1A). Handle 260 may extend away from the main body 120, e.g., it may extend outwardly from the apparatus lower end 116. It will be appreciated that the main body housing 124 and/or handle 260 may be in other configurations, shapes, and/or positions in other embodiments. For example, in embodiments wherein the energy storage member unit does not extend into the main body, the handle may be the rear end of the hand vacuum cleaner and connected to the main bogy by one or more forwardly extending bridge portions.

As exemplified, the handle 260 may be a pistol grip handle with a hand grip portion 264 that extends generally vertically. The handle 260 has a longest dimension in the direction of a handle longitudinal axis 268, which extends through a hand grip portion 264 from the handle upper end 272 to the handle lower end 276. The handle upper end 272 of the pistol grip handle may be mounted to a lower end of the surface cleaning apparatus 100.

The handle may include a handle base 280 (e.g., FIG. 2A) for acting as a stand when setting down the surface cleaning apparatus 100 on a surface.

The handle may underlie one or more of the suction motor 164, the pre-motor filter 248, and/or the air treatment assembly 172. Arranging the handle below a heavy and/or bulky component of the surface cleaning apparatus 100 may result in a more desirable hand-feel of the surface cleaning apparatus 100.

Optionally, energy storage members 288 may also be provided in the handle base 280.

Vertical Positioning of the Energy Storage Member Unit

The following is a description of the vertical positioning of energy storage member unit 284 that may be used by itself in any surface cleaning apparatus or in any combination or sub-combination with any other feature or features described herein.

In accordance with this aspect, power is supplied to the surface cleaning apparatus 100 at least one energy storage member unit 284 and optionally only a single energy storage member unit 284 (e.g., FIG. 1B). The energy storage member unit 284 may comprise a plurality of energy storage members 288, which may be a plurality of batteries or capacitors or the like.

The energy storage member unit 284 may be a single body which contains a plurality of energy storage members. The energy storage members may be arranged in a single row or a plurality of rows. As exemplified in FIGS. 1B and 1C, an energy storage member unit 284 has two rows of batteries wherein the long dimension of the batteries extend in a long dimension of the energy storage member unit 284. Accordingly, then installed in the handle, the axis of the energy storage member unit 284 and the longitudinal axis of the batteries therein may be parallel to the handle axis.

It will be appreciated that the energy storage member unit 284 may be dimensioned so as to fit between a user's fingers and palm when the user places their hand around the handle and grips the handle. Accordingly, as exemplified in FIGS. 1B and 1C, the energy storage member unit 284 has two rows of batteries, one behind the other. It will be appreciated that, in other embodiments, the rows may be positioned laterally side by side.

As exemplified in FIG. 1B, the energy storage member unit 284 comprises a plurality of energy storage members 288 that, in use, are axially arranged in a direction of the handle axis 268. Each energy storage member 288 has a length 300. The length 300 is the longest dimension of the energy storage member 288. In use, the length 300 extends in the direction of the handle axis 268, as exemplified, for example in FIG. 1B. As previously described, in some embodiments the energy storage members 288 may be a plurality of batteries 288. Each battery 288 has a positive end 304 and a negative end 308. In FIG. 1B, the positive end 304 is depicted at an upper end of the battery 288. It will be appreciated that in other embodiments, the positive end 304 may be located at a lower end of the battery 288. A battery axis 312 extends between the positive end 304 and the negative end 308. In use, the battery axis 312 extends in a common direction as the handle axis 268. As exemplified, for example in FIG. 1B, the batteries 288 may be stacked end to end within the handle 260 and extend into the main body 120.

It will be appreciated that, in other embodiment, the battery axis may extend transversely (i.e., in a plane generally transverse to the cyclone axis of rotation).

In accordance with this aspect, at least a portion of the energy storage member unit 284 is located within both the handle 260 and the main body 120. As exemplified in FIGS. 1B, 2A, 3A, 4A and 5A, a first portion 292 of the energy storage member unit 284 is provided in the handle 260, in the hand grip portion 264 as exemplified. A second portion 296 of the energy storage member unit 284 is provided in the main body 120. Providing for the energy storage member unit 284 to extend from within the handle 260 into the main body 120 allows for more and/or larger energy storage members 288 to be used to power the surface cleaning apparatus 100 while maintaining a compact form. This may allow for the surface cleaning apparatus 100 to have a longer run time and/or stronger suction power.

It will be appreciated that the second portion 296 of the energy storage member unit 284 may extend from the handle 260 part wall into the main body or through most or all of the vertical height of the main body. As exemplified herein, in the orientation of FIG. 2A, the surface cleaning apparatus 100 has a lower side 332 and an opposed upper side 336. The handle 260 is provided on the lower side 332. As exemplified in FIGS. 1B, 2A, and 3A, the energy storage member unit 284 extends from the lower side 332 through all of the vertical height of the main body to the upper side 336. Accordingly, the energy storage member unit 284 extends generally through an entire height 316 of the main body housing 124. Therefore, the second portion 296 extends from the lower side 332 to the upper side 336.

Figure 4A:
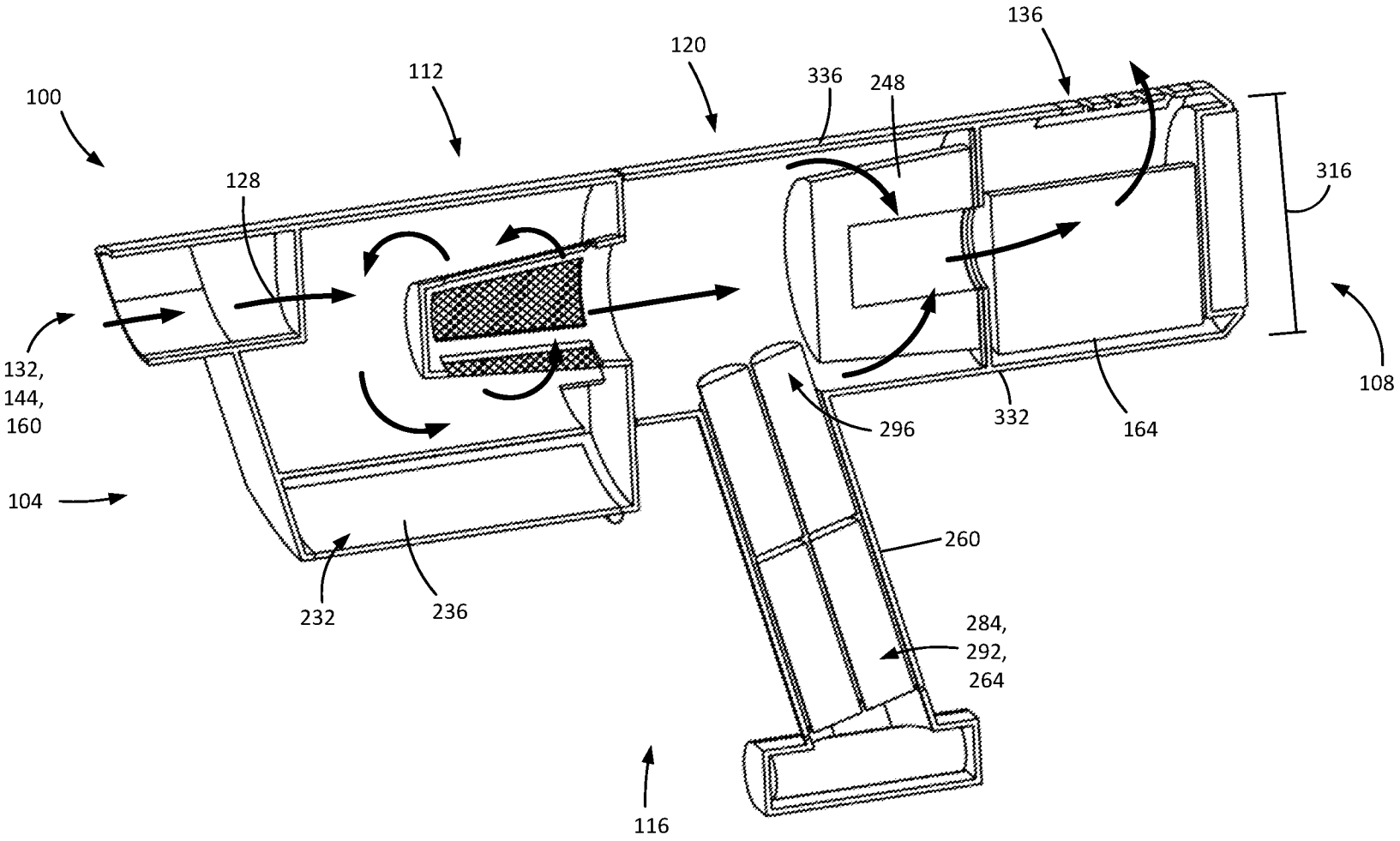
FIG. 4A is a cross-sectional side perspective view taken in a vertical plane extending through the lateral center of the cyclone air outlet of a further alternative embodiment of a surface cleaning apparatus.
Figure 4B:
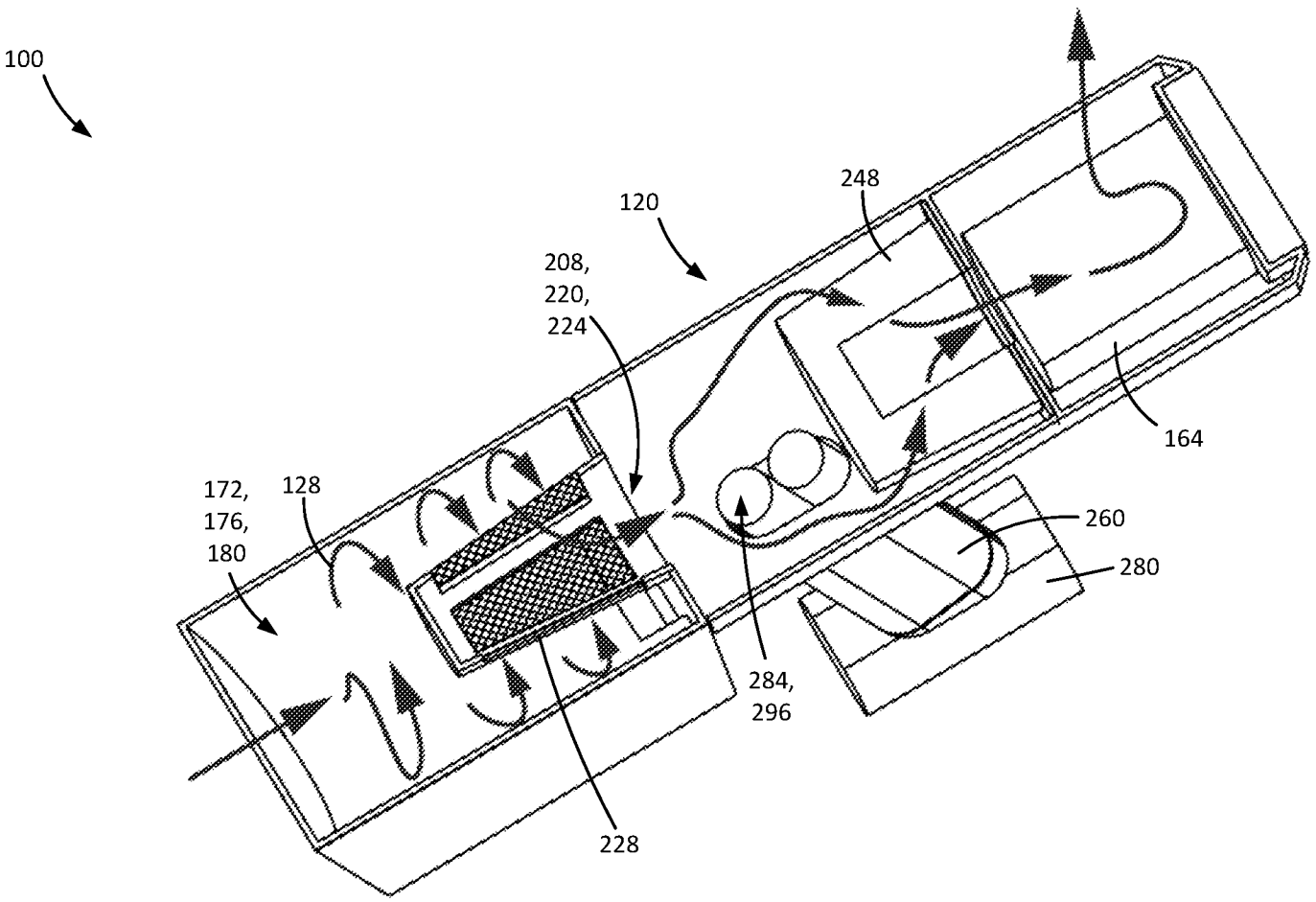
FIG. 4B is a cross-sectional top perspective view taken in a horizontal plane that extends through the vertical center of the cyclone air outlet of the surface cleaning apparatus of FIG. 4A.
Figure 5A:
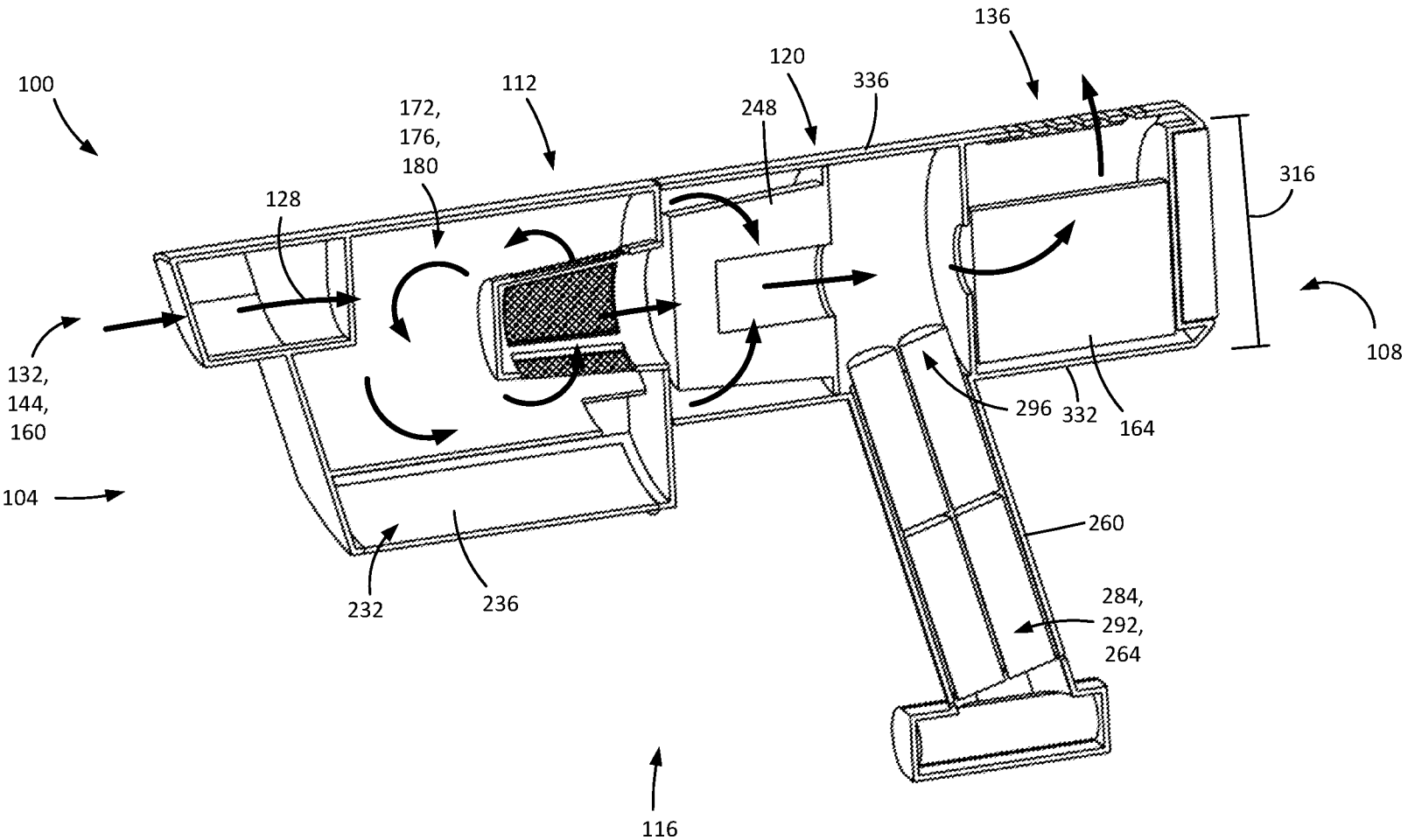
FIG. 5A is a cross-sectional side perspective view taken in a vertical plane extending through the lateral center of the cyclone air outlet of a further alternative embodiment of a surface cleaning apparatus.
Figure 5B:
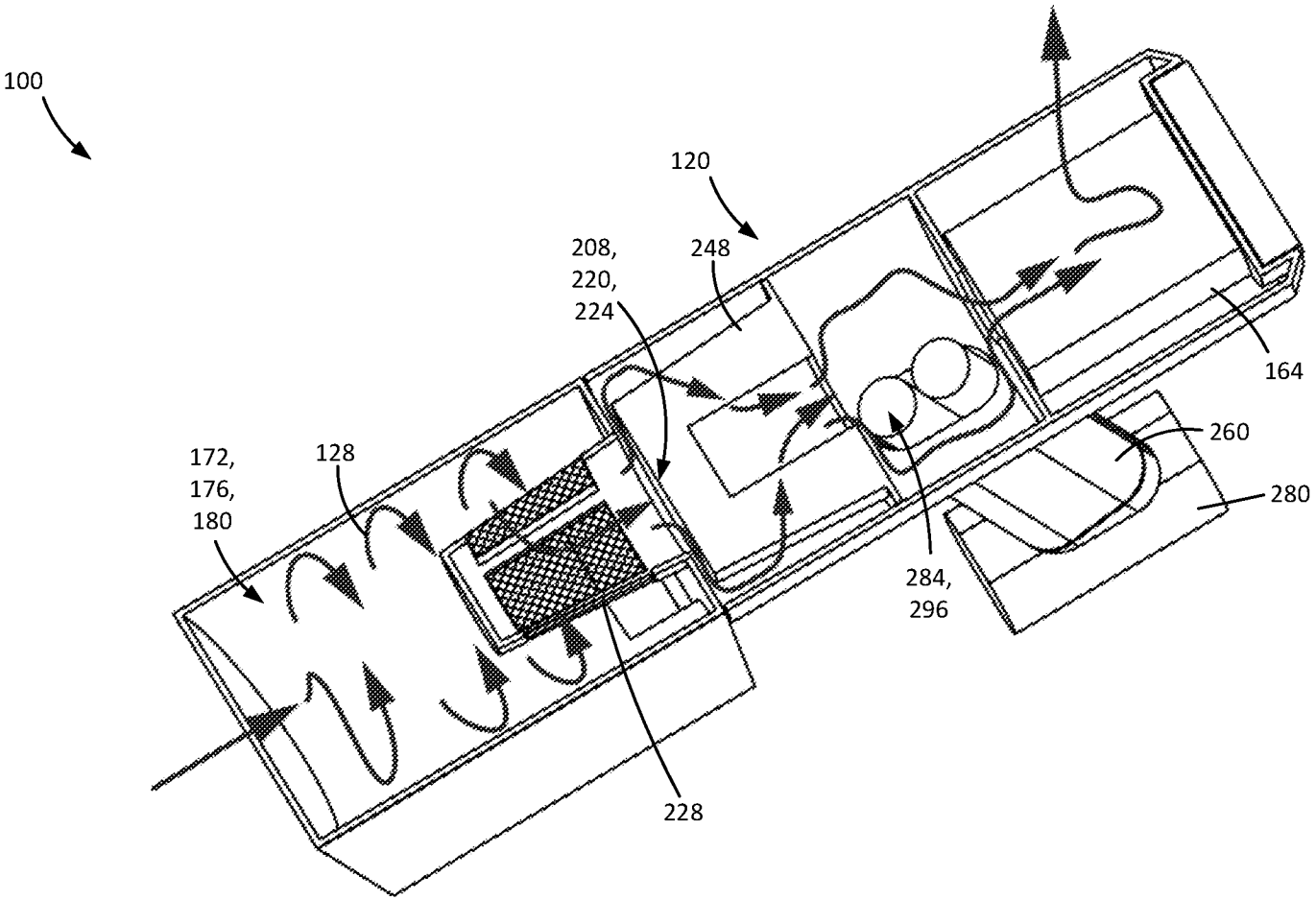
FIG. 5B is a cross-sectional top perspective view taken in a horizontal plane that extends through the vertical center of the cyclone air outlet of the surface cleaning apparatus of FIG. 5A.

In other embodiments, such as in FIGS. 4A and 5A, the energy storage member unit 284 may not extend all the way from the lower side 332 to the upper side 336 (i.e., through the entire height 316). As exemplified in FIGS. 4A and 5A, the second portion 296 of the energy storage member unit 284 extends only approximately one-quarter of the height 316. In other embodiments, the second portion 296 may extend through any amount of the height 316 (e.g., one-half of height 316, three-quarters of height 316, etc.). In different embodiments, the amount the second portion 296 that extends into the main body 120 (i.e., the distance the second portion 296 extends away from the lower 332 towards the second rearwardly extending side 336) may differ due to the use of energy storage members 288 of different dimensions.

Figure 2A:
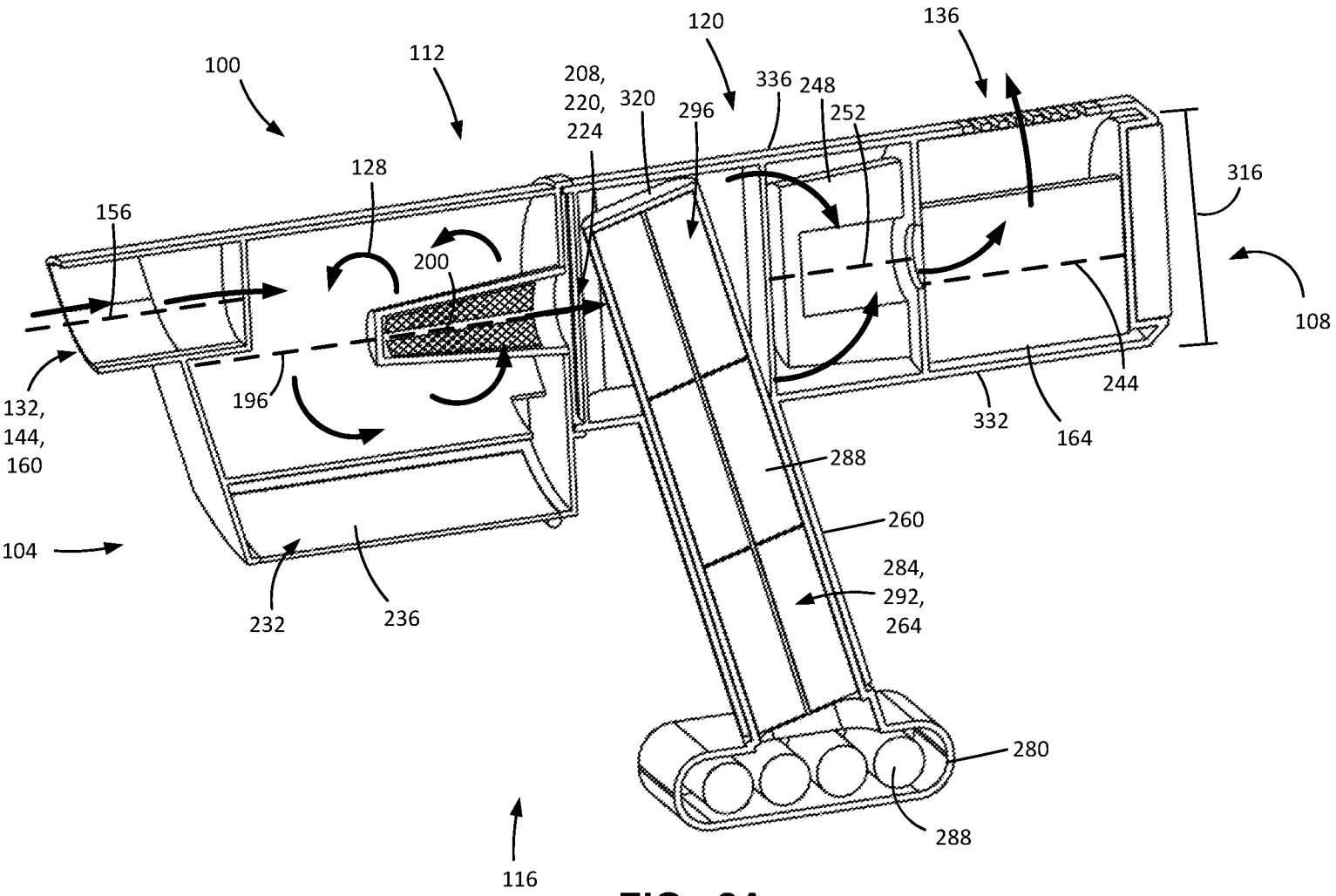
FIG. 2A is a cross-sectional side perspective view taken in a vertical plane extending through the lateral center of the cyclone air outlet of a further alternative embodiment of a surface cleaning apparatus.

It will be appreciated that, if the energy storage member unit 284 is shorter than the axial length of the handle 260, then the lower end of the energy storage member unit 284, in the orientation of FIG. 2A, may be at an elevation higher than the lower end of the handle 260 and therefore the center of gravity of, e.g., the batteries, may be located closer to the elevation of the suction motor. Accordingly, for example, in the embodiment of FIG. 2A, each row in the energy storage member unit 284 may consist of 2 batteries (i.e., the energy storage member unit 284 may have 4 batteries). In such a case, the lower two batteries shown in FIG. 2A are not provided and the lower end of the energy storage member unit 284 is located at about a mid-height of the handle 260

Accordingly, it will be appreciated that an axial projection of the suction motor may intersect part of the second portion 296 of the energy storage member unit 284, e.g., the upper portion thereof in the embodiment of FIG. 4A. Alternately, in the embodiment of FIG. 2A, an axial projection of the suction motor may intersect all or essentially all of the second portion 296 of the energy storage member unit 284. Optionally, if the motor axis extends in the forward/rearward direction, then the motor axis of rotation 224 may intersects the second portion 296, e.g., an upper end thereof of a middle of the vertical height of the second portion 296.

It will be appreciated that the second portion 296 of the energy storage member unit 284 may be positioned in the apparatus air flow path 128. The air flow path 128 may flow over, around and/or above the second portion 296 of the energy storage member unit 284. In some embodiments, the air flow path 128 may flow through the energy storage members 288 (e.g., between the batteries of a battery pack) or through air flow passages through, e.g., a batter pack. Airflow over the second portion 296 may help cool the energy storage members 288.

It will be appreciated that the air exiting the air treatment chamber outlet 220 may still carry dust and/or debris. It may be desirable, therefore, to protect the second portion 296 of the energy storage member unit 284 that is in the air flow path 128 in order to prevent the accumulation of dust and/or debris on the energy storage members 288. In order to protect the second portion 296, various methods may be used to block the air flow path from contact with the second portion 296. This may help prevent damage to the energy storage members 288 and extend their lifetime.

For example, in the embodiment shown in FIG. 2A, the energy storage member unit 284 is encased in a casing 320. The casing 320 may cover all sides of the energy storage member unit 284 that is in the main body 120 such that the air flow is never in direct contact with the energy storage member unit 284. Accordingly, for example, the energy storage member unit 284 may be a sealed enclosure, like a battery pack.

It will be appreciated that the casing 320 may be in other configurations, shapes, and/or positions in other embodiments.

Figure 2B:
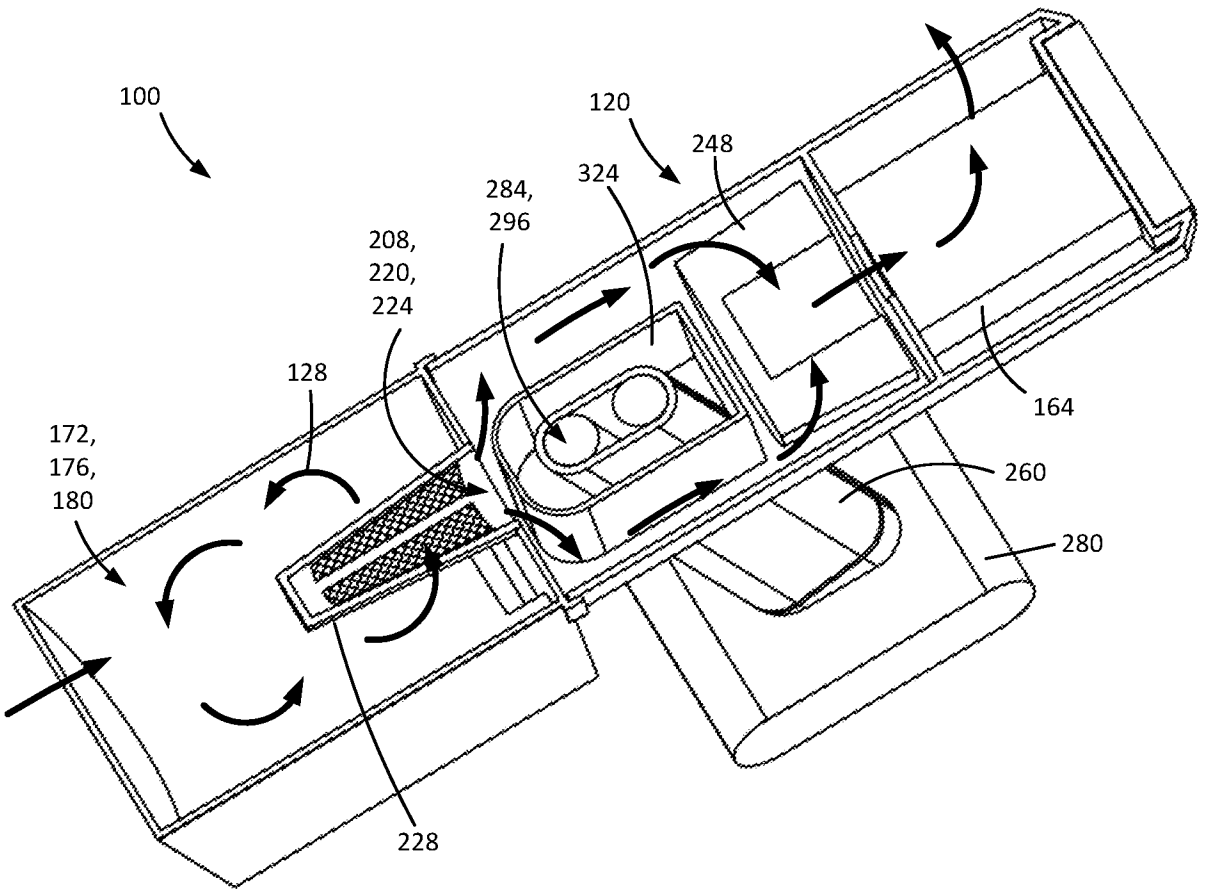
FIG. 2B is a cross-sectional top perspective view taken in a horizontal plane that extends through the vertical center of the cyclone air outlet of the surface cleaning apparatus of FIG. 2A.
Figure 3A:
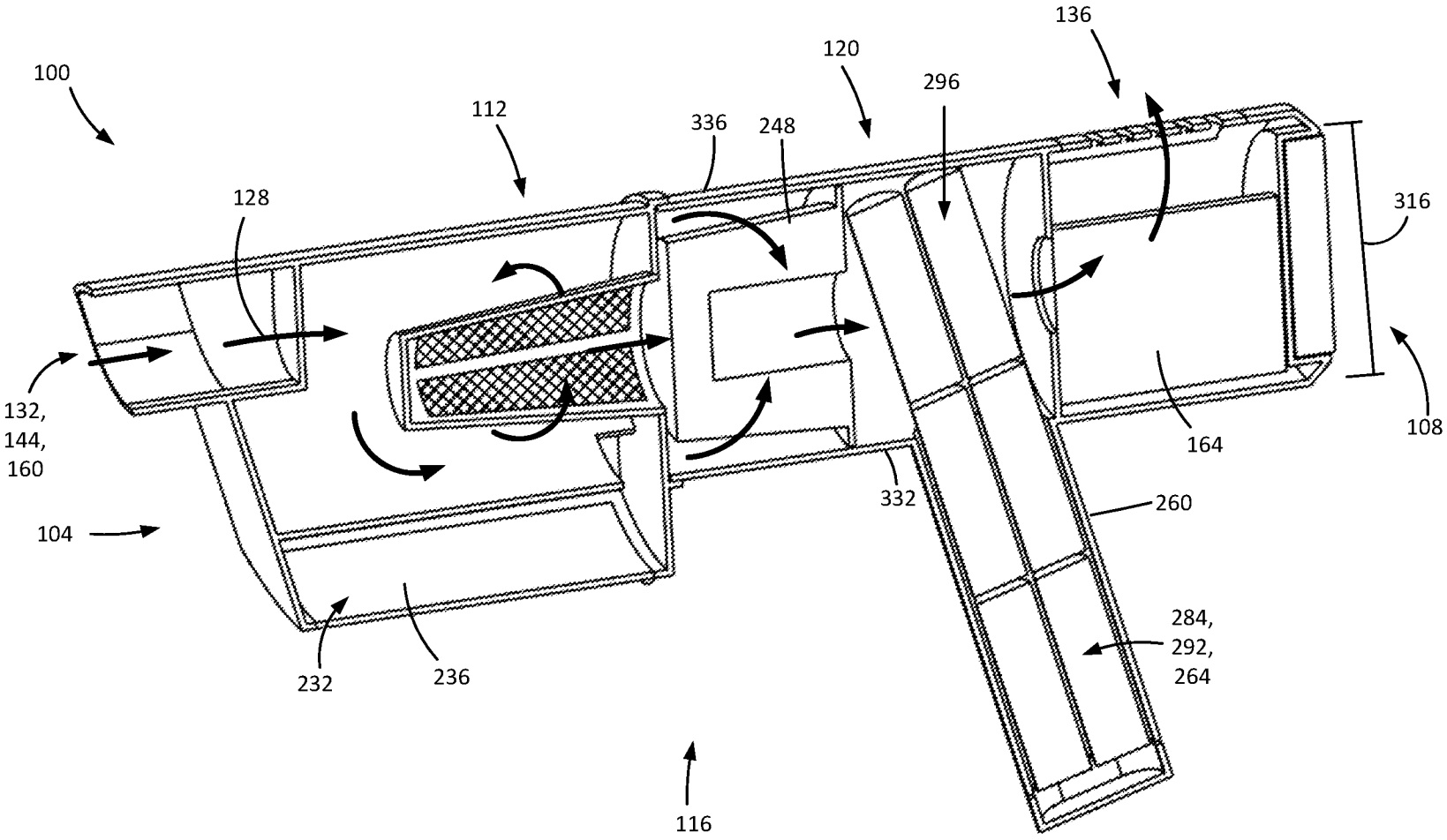
FIG. 3A is a cross-sectional side perspective view taken in a vertical plane extending through the lateral center of the cyclone air outlet of a further alternative embodiment of a surface cleaning apparatus.
Figure 3B:
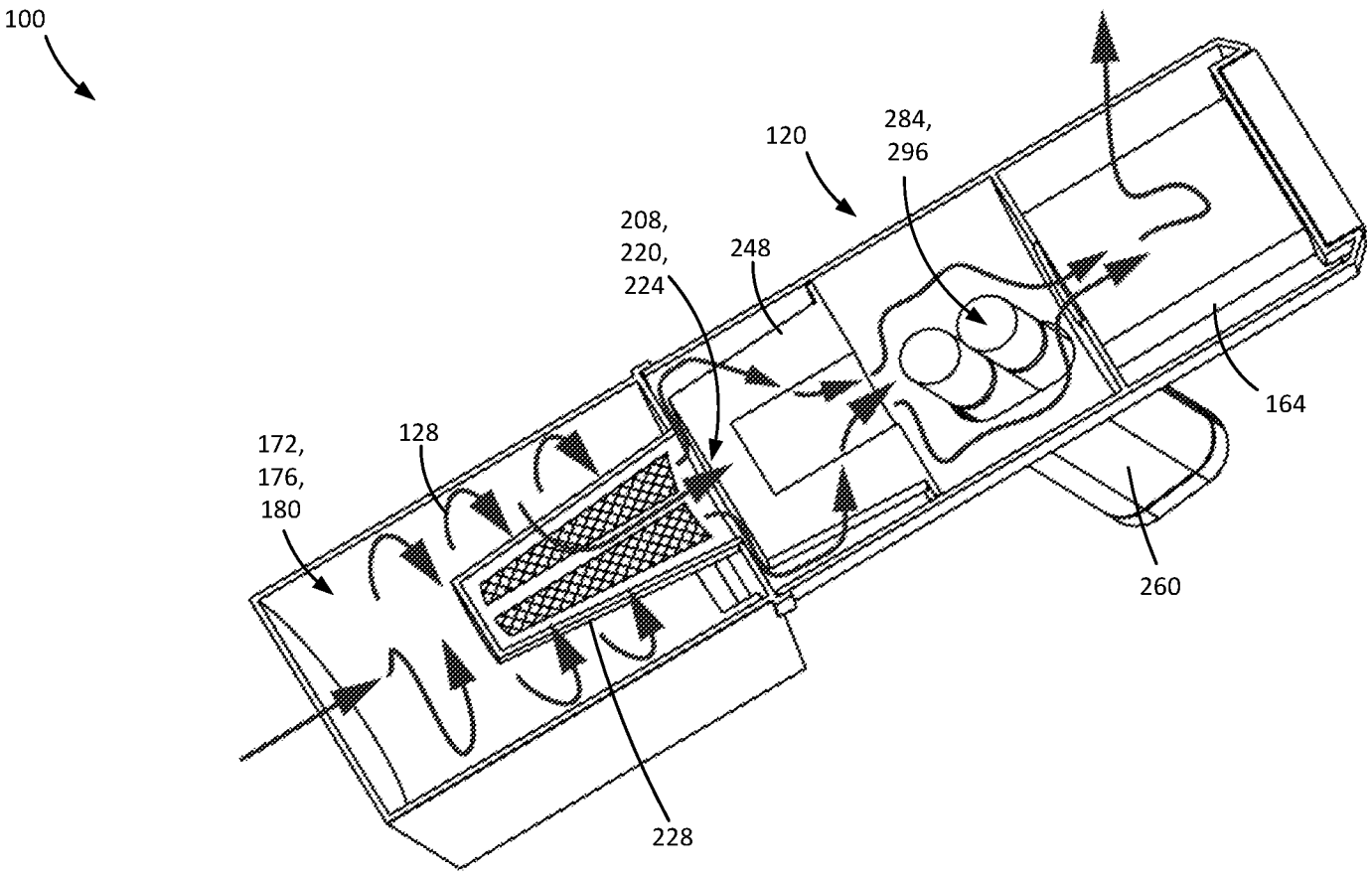
FIG. 3B is a cross-sectional top perspective view taken in a horizontal plane that extends through the vertical center of the cyclone air outlet of the surface cleaning apparatus of FIG. 3A.

In the embodiment shown in FIG. 2B, the surface cleaning apparatus 100 may include an energy storage protection wall 324. The energy storage protection wall 324 may encircle the second portion 296 to prevent air from flowing over the second portion 296. The energy storage protection wall 324 may force the airflow path 128 around and/or above the second portion 296. The energy storage protection wall 324 may extend from the lower side 332 to the upper end of the second portion 296 (when installed) and optionally to the upper side 336. The energy storage protection wall 324 may extend only partially from the lower side 332 towards the upper side 336. Accordingly, the energy storage protection wall 324 may be in the form of cup or container having a lower open side into which the second portion 296 is inserted. The energy storage protection wall 324 may be mounted or integrally formed to an inner surface of the lower side 332 It will be appreciated that the energy storage protection wall 324 may be in other configurations, shapes and/or positions in other embodiments.

It will be appreciated that the energy storage member unit 284 may be removable from the surface cleaning apparatus 100 in any suitable manner. For example, the energy storage member unit 284 may be removably insertable into the handle 260 as discussed subsequently.

Axial Positioning of the Energy Storage Member Unit

The following is a description of the axial positioning of energy storage member unit 284 that may be used by itself in any surface cleaning apparatus or in any combination or sub-combination with any other feature or features described herein.

In accordance with this aspect, if a pre-motor filter us provided, then some or all of the energy member unit 284 may be located forward or rearward of the pre-motor filter 248.

As exemplified in FIGS. 1B, 2A and 4A, the second portion 296 of the energy member unit 284 is be located forward of the pre-motor filter 248. Alternately, as exemplified in FIGS. 3A and 5A, the second portion 296 of the energy member unit 284 is be located rearward of the pre-motor filter 248 and forward of the suction motor 164.

In either case, the second portion 296 of the energy member unit 284 is located forward of the suction motor. Arranging the energy member unit 284 forward of the suction motor 164 may result in a more desirable weight distribution and hand-feel of the surface cleaning apparatus 100, particularly if the second portion 296 is located rearward of the pre-motor filter 248 and, optionally adjacent a forward (air inlet end) of the suction motor 264.

It will be appreciated that the energy storage member unit 284 may be removable from the surface cleaning apparatus 100 in any suitable manner. For example, the energy storage member unit 284 may be removably insertable into the handle 260 as discussed subsequently.

Removable Energy Storage Member Unit

The following is a description of the removability of energy storage member unit 284 that may be used by itself in any surface cleaning apparatus or in any combination or sub-combination with any other feature or features described herein.

Optionally, as discussed elsewhere herein, the energy storage member unit 284 may be removable. When installed, the energy storage member unit 284 may be located at least partially within the handle 260. The energy storage member unit may have a lower end, in the orientation of FIG. 1B, that is recessed inwardly from the lower end 276 of the handle 260 or at the handle lower end 276.

In accordance with this aspect, the upper end of the energy storage member unit 284, when installed, may be located in the handle or in the main body as discussed previously.

In accordance with this aspect, the energy storage member unit 284 is removably insertable into the handle 260.

Figure 6:
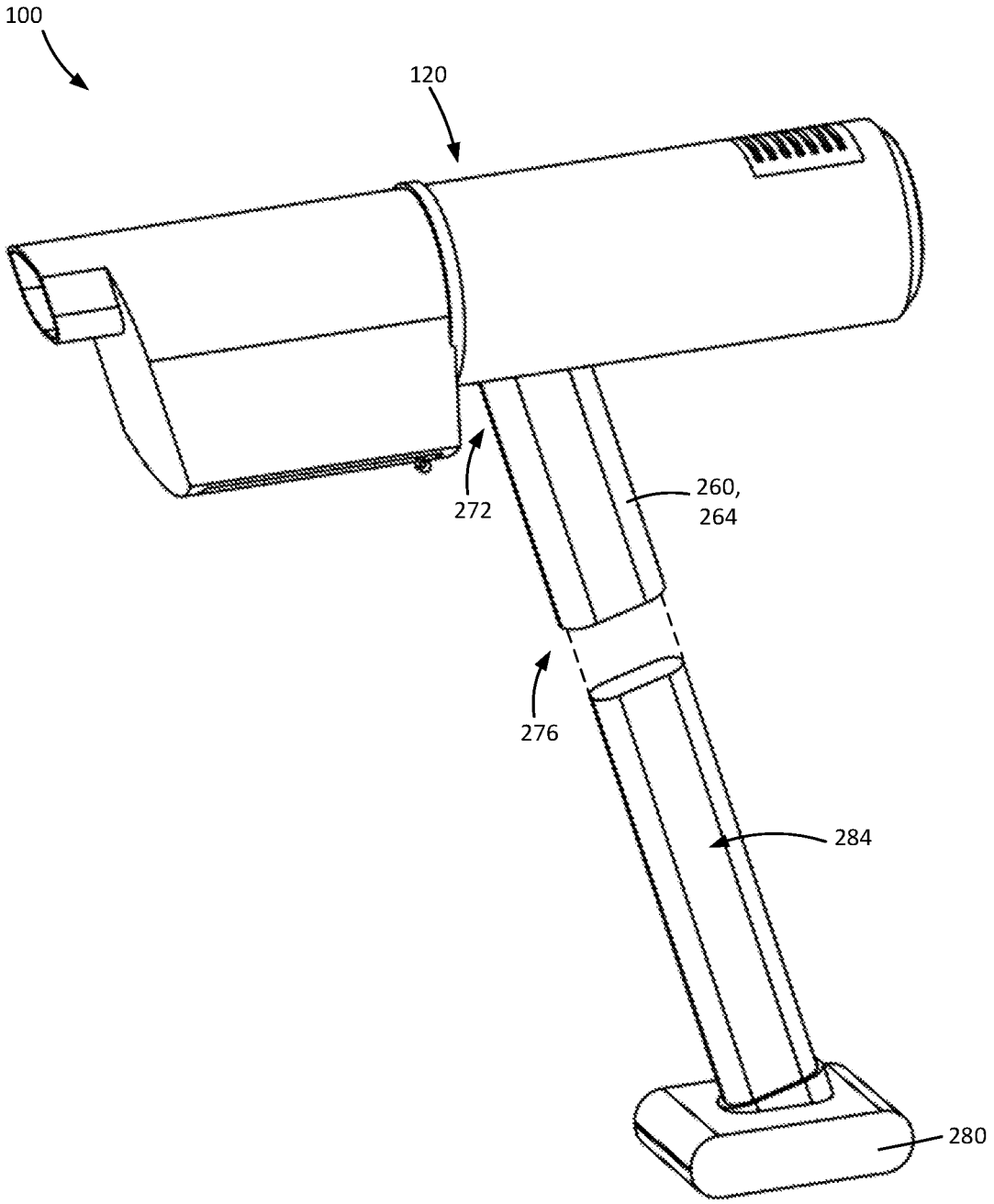
FIG. 6 is a side perspective view of a further alternative embodiment of a surface cleaning apparatus, shown with the handle base and energy storage member unit removed.

As exemplified in FIG. 6, the energy storage member unit 284 may be insertable into the handle 260 through the handle lower end 276. In this manner, the energy storage member unit 284 may be slidingly received in the direction of the handle axis into the handle 260. As shown in FIG. 6, the handle 260 may remain mounted to the main body 120 when the energy storage member unit 284 is removed.

If the handle 260 has a handle base 280, as exemplified in FIG. 6, the handle base 280 may be attached to the energy storage member unit 284 such that the handle base 280 is removed from the handle 260 along with the energy storage member unit 284 and is positioned at the lower end of the handle when the energy storage member unit 284 is in the installed position as exemplified in FIG. 5A.

The base may be fixedly mounted to the energy storage member unit 284 or it may be removably attachable to the energy storage member unit 284 and/or the lower end of the hand grip portion. For example, the base may have a cavity into which the lower end of the energy storage member unit 284 or the lower end of the hand grip portion is insertable. Alternately, the base may have a protrusion (see e.g., FIG. 7) which is insertable into a cavity in the lower end of the energy storage member unit 284 or the lower end of the hand grip portion.

Figure 7:
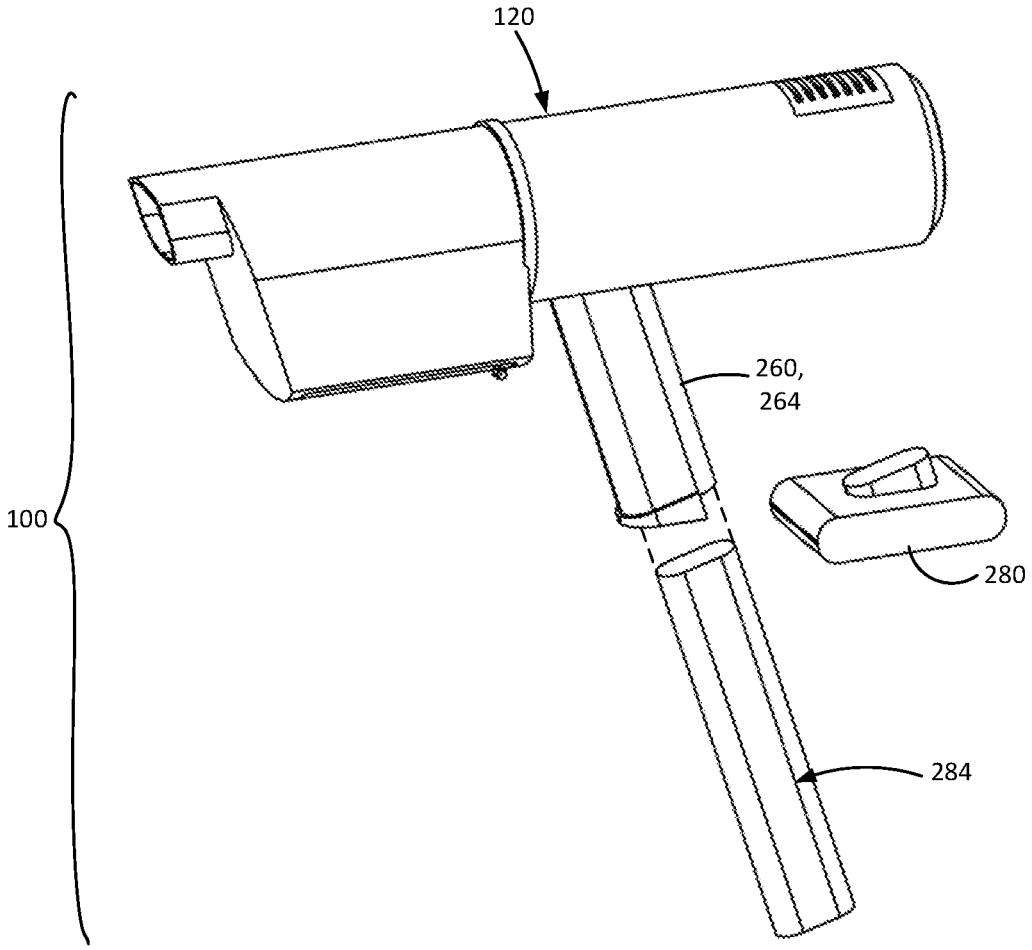
FIG. 7 is a side perspective view of a further alternative embodiment of a surface cleaning apparatus, shown with the handle base and energy storage member unit removed.

As exemplified in FIG. 7, the handle base 280 is removable from the handle 260. Therefore, the handle base 280 may be removed from the handle 260 prior to removing the energy storage member unit 284 through the lower end of the hand grip portion of the handle 260.

Figure 9:
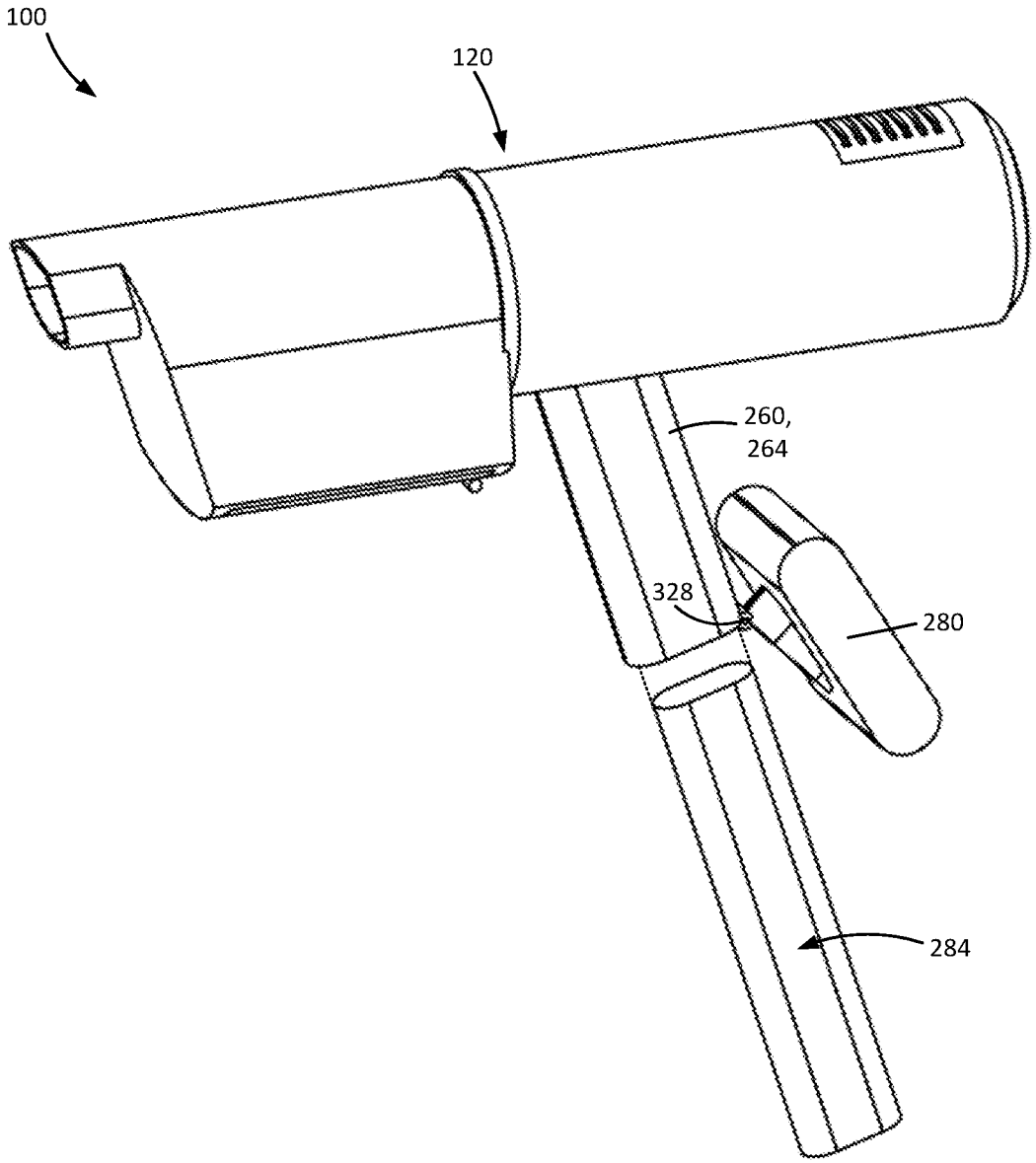

As exemplified in FIG. 9, the handle 260 has a handle pivot joint 328. The handle base 280 is pivotably mounted to the handle 260 via the handle pivot joint 328. The handle base 280 may be pivoted away from the lower end of the hand grip portion of the handle 260 to open the handle lower end 276 and allow for the energy storage member unit 284 to be removed from the handle 260.

Figure 8:
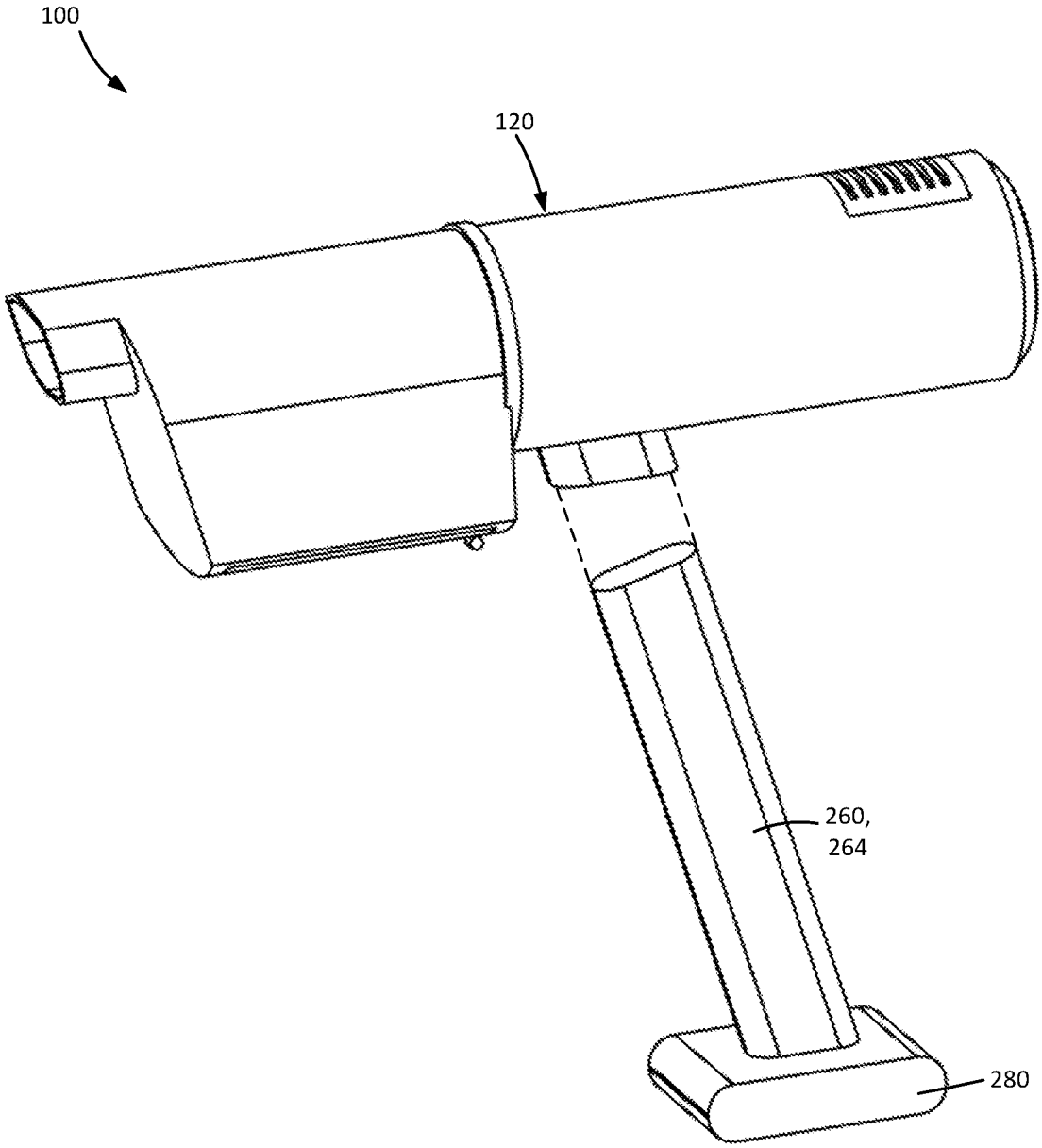
FIG. 8 is a side perspective view of a further alternative embodiment of a surface cleaning apparatus, shown with the handle removed; and, FIG. 9 is a side perspective view of a further alternative embodiment of a surface cleaning apparatus, shown with the energy storage member unit removed.

Alternately, as exemplified in FIG. 8, the handle 260 may be removably mounted to the remainder of the surface cleaning apparatus 100 (i.e., the main body 120). The handle 260 is removable with the energy storage member unit 284. In other words, the handle 260 containing the energy storage member unit 284 may be removed from the main body 120. With the handle 260 removed from the main body 120, the energy storage member unit 284 may subsequently be removed from the handle 260. Alternately, the energy storage member unit may be permanently mounted in the handle 260 or it may form part or all of the handle 260. It will be appreciated that if a handle base 280 is provided, the handle base may be permanently attached to the handle 260 or removable or pivotally mounted as discussed previously, e.g., to enable removal of the energy storage member unit 284 from the handle.

It will be appreciated that, if the handle is removable for the hand vacuum cleaner and the energy storage member unit 284 is removable from the handle, then the energy storage member unit 284 may be removeable through an open upper end of the hand after the handle has been removed from the hand vacuum cleaner.

It will also be appreciated if the energy storage member unit 284 has a second portion 296 that is received in the main body when the energy storage member unit 284 is installed in an operating position, then when the handle 260 is removed, the second portion 296 may extend upwardly out of the upper end of the handle and function as a grip portion for removing a removable energy storage member unit 284 upwardly out of the handle.

Accordingly, what has been described above is intended to be illustrative of the claimed concept and non-limiting. It will be understood by persons skilled in the art that other variants and modifications may be made without departing from the scope of the invention as defined in the claims appended hereto. The scope of the claims should not be limited by the preferred embodiments and examples, but should be given the broadest interpretation consistent with the description as a whole.

CLAUSES

Clause Set 1

1. A hand vacuum cleaner comprising:

(a) an airflow path from a dirty air inlet positioned at a front end of the hand vacuum cleaner to a clean air outlet positioned rearward of the dirty air inlet;

(b) an air treatment assembly comprising an air treatment chamber, the air treatment chamber positioned in the airflow path, the air treatment chamber has an air treatment chamber air inlet, an air treatment chamber air outlet, a front end, a rear end and a centrally positioned longitudinal axis extending between the front and rear ends of the air treatment chamber;

(c) a main body housing a motor and fan assembly that is positioned in the air flow path, the motor and fan assembly having a motor axis of rotation;

(d) a handle extending away from the main body; and, (e) an energy storage member unit, wherein a first portion of the energy storage member unit is provided in the handle and a second portion of the energy storage member unit is provided in the main body.

2. The hand vacuum cleaner of clause 1 wherein the handle has a first end, an opposed second end, a hand grip portion and a handle axis that extends through the hand grip portion from the first end to the opposed second end and, in use, the first portion of the energy storage member unit is provided in the hand grip portion.

3. The hand vacuum cleaner of clause 2 wherein the handle is a pistol grip handle.

4. The hand vacuum cleaner of clause 1 wherein the handle has a first end, an opposed second end, a hand grip portion and a handle axis that extends through the hand grip portion from the first end to the opposed second end, the energy storage member unit comprises a plurality of energy storage members that, in use, are axially arranged in a direction of the handle axis.

5. The hand vacuum cleaner of clause aim 1 wherein the handle has a first end, an opposed second end, a hand grip portion and a handle axis that extends through the hand grip portion from the first end to the opposed second end, the energy storage member unit comprises a plurality of energy storage members that have a length, which is a longest dimension of the energy storage member, and, in use, the length extends in a direction of the handle axis.

6. The hand vacuum cleaner of clause 1 wherein the handle has a first end, an opposed second end, a hand grip portion and a handle axis that extends through the hand grip portion from the first end to the opposed second end, the energy storage member unit comprises a plurality of batteries that have a positive end and a negative end, a battery axis extends between the positive and negative ends and, in use, the battery axis extends in a common direction as the handle axis.

7. The hand vacuum cleaner of clause 1 wherein, in use, the energy storage member unit is positioned in the air flow path.

8. The hand vacuum cleaner of clause 1 wherein, in use, the second portion of the energy storage member unit is positioned forward of the motor and fan assembly.

9. The hand vacuum cleaner of clause 1 wherein the main body further comprises a pre-motor filter and, in use, the second portion of the energy storage member unit is positioned forward of the motor and fan assembly and forward of the pre-motor filter.

10. The hand vacuum cleaner of clause 1 wherein the main body further comprises a pre-motor filter and, in use, the second portion of the energy storage member unit is positioned forward of the motor and fan assembly and rearward of the pre-motor filter.

11. The hand vacuum cleaner of clause 1 wherein the energy storage member unit is removable from the hand vacuum cleaner.

12. The hand vacuum cleaner of clause 1 wherein the energy storage member unit is removable insertable into the handle.

13. The hand vacuum cleaner of clause 1 wherein the handle has a first end provided on the main body, an opposed second end and a hand grip portion positioned between the first end and the opposed second end of the handle, and the energy storage member unit is insertable into the second end of the handle.

14. The hand vacuum cleaner of clause 1 wherein, in use, the motor axis of rotation intersects the second portion of the energy storage member unit.

15. A hand vacuum cleaner comprising:

(a) an airflow path from a dirty air inlet positioned at a front end of the hand vacuum cleaner to a clean air outlet positioned rearward of the dirty air inlet;

(b) an air treatment assembly comprising an air treatment chamber, the air treatment chamber positioned in the airflow path, the air treatment chamber has an air treatment chamber air inlet, an air treatment chamber air outlet, a front end, a rear end and a centrally positioned longitudinal axis extending between the front and rear ends of the air treatment chamber;

(c) a main body housing a motor and fan assembly that is positioned in the air flow path, the motor and fan assembly having a motor axis of rotation;

(d) a handle having a first end, an opposed second end, a hand grip portion positioned between the first end and the opposed second end of the handle and a handle axis that extends through the hand grip portion from the first end to the opposed second end; and, (e) an energy storage member unit comprising a plurality of energy storage members that have a length, which is a longest dimension of the energy storage member, and in use the length extends in a direction of the handle axis, wherein, in use, the motor axis of rotation intersects the energy storage member unit and the motor and fan assembly is located rearward of at least one of the energy storage members.

16. The hand vacuum cleaner of clause 15 wherein, in use, a portion of the energy storage member unit is positioned in the main body.

17. The hand vacuum cleaner of clause 15 wherein, in use, a portion of the energy storage member unit is positioned rearward of a pre-motor filter.

18. A hand vacuum cleaner comprising:

(a) an airflow path from a dirty air inlet positioned at a front end of the hand vacuum cleaner to a clean air outlet positioned rearward of the dirty air inlet;

(b) an air treatment assembly comprising an air treatment chamber, the air treatment chamber positioned in the airflow path, the air treatment chamber has an air treatment chamber air inlet, an air treatment chamber air outlet, a front end, a rear end and a longitudinal axis that extends between the front and rear ends of the air treatment chamber;

(c) a main body housing a motor and fan assembly that is positioned in the air flow path, the motor and fan assembly having a motor axis of rotation;

(d) a handle having a first end, an opposed second end, a hand grip portion positioned between the first end and the opposed second end of the handle and a handle axis that extends through the hand grip portion from the first end to the opposed second end; and, (e) an energy storage member unit comprising a plurality of energy storage members that have a length, which is a longest dimension of the energy storage member, and in use the length extends in a direction of the handle axis, wherein, in use, the longitudinal axis intersects the energy storage member unit and the motor and fan assembly is located rearward of at least one of the energy storage members.

19. The hand vacuum cleaner of clause 18 wherein, in use, a portion of the energy storage member unit is positioned in the main body.

20. The hand vacuum cleaner of clause 18 wherein, in use, a portion of the energy storage member unit is positioned rearward of a pre-motor filter.

Clause Set 2

A hand vacuum cleaner comprising:

(a) an airflow path from a dirty air inlet positioned at a front end of the hand vacuum cleaner to a clean air outlet positioned rearward of the dirty air inlet;

(b) an air treatment assembly comprising an air treatment chamber, the air treatment chamber positioned in the airflow path, the air treatment chamber has an air treatment chamber air inlet, an air treatment chamber air outlet, a front end, a rear end and a centrally positioned longitudinal axis extending between the front and rear ends of the air treatment chamber;

(c) a main body housing a motor and fan assembly that is positioned in the air flow path, the motor and fan assembly having a motor axis of rotation;

(d) a handle extending away from the main body; and, (e) an energy storage member unit that is removably insertable into the handle.

2. The hand vacuum cleaner of clause 1 wherein the handle has a first end provided on the main body, an opposed second end, a hand grip portion positioned between the first end and the opposed second end of the handle and the energy storage member unit is removably insertable through the second end of the handle.

3. The hand vacuum cleaner of clause 1 wherein, when inserted, the energy storage member unit is recessed inwardly into the handle from the second end of the handle.

4. The hand vacuum cleaner of clause 1 wherein the handle is a pistol grip handle.

5. The hand vacuum cleaner of clause 1 wherein, in use, a portion of the energy storage member unit is positioned in the main body.

6. The hand vacuum cleaner of clause 5 wherein, in use, the portion of the energy storage member unit that is positioned in the main body is located forward of the motor and fan assembly.

7. The hand vacuum cleaner of clause 6 wherein, in use, the portion of the energy storage member unit that is positioned in the main body is located forward of a pre-motor filter.

8. The hand vacuum cleaner of clause 6 wherein, in use, the portion of the energy storage member unit that is positioned in the main body is located rearward of a pre-motor filter.

9. The hand vacuum cleaner of clause 6 wherein, in use, the portion of the energy storage member unit that is positioned in the main body is provided in the air flow path.

10. The hand vacuum cleaner of clause 1 wherein the handle has a first end, an opposed second end, a hand grip portion and a handle axis that extends through the hand grip portion from the first end to the opposed second end, the energy storage member unit comprises a plurality of energy storage members that, in use, are axially arranged in a direction of the handle axis.

11. The hand vacuum cleaner of clause 1 wherein the handle has a first end, an opposed second end, a hand grip portion and a handle axis that extends through the hand grip portion from the first end to the opposed second end, the energy storage member unit comprises a plurality of energy storage members that have a length, which is a longest dimension of the energy storage member, and, in use, the length extends in a direction of the handle axis.

12. The hand vacuum cleaner of clause 1 wherein the handle has a first end, an opposed second end, a hand grip portion and a handle axis that extends through the hand grip portion from the first end to the opposed second end, the energy storage member unit comprises a plurality of batteries that have a positive end and a negative end, a battery axis extends between the positive and negative ends and, in use, the battery axis extends in a common direction as the handle axis.

13. The hand vacuum cleaner of clause 1 wherein the handle is removably mounted to a remainder of the hand vacuum cleaner.

14. The hand vacuum cleaner of clause 13 wherein the handle is removably mounted to the main body.

15. The hand vacuum cleaner of clause 13 wherein the handle is removable with the energy storage member unit.

16. The hand vacuum cleaner of clause 1 wherein the handle comprises a stand for the hand vacuum cleaner.

17. The hand vacuum cleaner of claim 1 wherein the second end of the handle comprises a stand for the hand vacuum cleaner.

18. The hand vacuum cleaner of clause 1 wherein the second end of the handle is a stand for the hand vacuum cleaner.

19. The hand vacuum cleaner of clause 1 wherein the hand vacuum cleaner has a first rearwardly extending side on which the handle is provided and an opposed second rearwardly extending side.

20. The hand vacuum cleaner of clause 1 wherein, in use, the energy storage member unit extends from the first rearwardly extending side to the opposed second rearwardly extending side.

The invention claimed is:

1. A hand vacuum cleaner comprising:

(a) an airflow path from a dirty air inlet positioned at a front end of the hand vacuum cleaner to a clean air outlet positioned rearward of the dirty air inlet;

(b) an air treatment assembly comprising an air treatment chamber, the air treatment chamber positioned in the airflow path, the air treatment chamber has an air treatment chamber air inlet, an air treatment chamber air outlet, a front end, a rear end and a centrally positioned longitudinal axis extending between the front and rear ends of the air treatment chamber;

(c) a main body housing a motor and fan assembly that is positioned in the air flow path, the motor and fan assembly having a motor axis of rotation;

(d) a handle extending away from the main body; and, (e) a unitary energy storage housing, wherein a first portion of the energy storage housing is provided in the handle and a second portion of the energy storage housing is provided in the main body, wherein, in use, the second portion of the energy storage housing, which is provided in the main body, is positioned forward of the motor and fan assembly.

2. The hand vacuum cleaner of claim 1 wherein the handle has a first end, an opposed second end, a hand grip portion and a handle axis that extends through the hand grip portion from the first end to the opposed second end and, in use, the first portion of the energy storage housing is provided in the hand grip portion.

3. The hand vacuum cleaner of claim 2 wherein the handle is a pistol grip handle.

4. The hand vacuum cleaner of claim 1 wherein the handle has a first end, an opposed second end, a hand grip portion and a handle axis that extends through the hand grip portion from the first end to the opposed second end, the energy storage housing comprises a plurality of energy storage members that, in use, are axially arranged in a direction of the handle axis.

5. The hand vacuum cleaner of claim 1 wherein the handle has a first end, an opposed second end, a hand grip portion and a handle axis that extends through the hand grip portion from the first end to the opposed second end, the energy storage housing comprises a plurality of energy storage members that have a length, which is a longest dimension of the energy storage member, and, in use, the length extends in a direction of the handle axis.

6. The hand vacuum cleaner of claim 1 wherein the handle has a first end, an opposed second end, a hand grip portion and a handle axis that extends through the hand grip portion from the first end to the opposed second end, the energy storage housing comprises a plurality of batteries that have a positive end and a negative end, a battery axis extends between the positive and negative ends and, in use, the battery axis extends in a common direction as the handle axis.

7. The hand vacuum cleaner of claim 1 wherein, in use, the energy storage housing positioned in the air flow path.

8. The hand vacuum cleaner of claim 1 wherein the main body further comprises a pre-motor filter and, in use, the second portion of the energy storage housing is positioned forward of the pre-motor filter.

9. The hand vacuum cleaner of claim 1 wherein the main body further comprises a pre-motor filter and, in use, the second portion of the energy storage housing is positioned rearward of the pre-motor filter.

10. The hand vacuum cleaner of claim 1 wherein the energy storage housing is removable from the hand vacuum cleaner.

11. The hand vacuum cleaner of claim 1 wherein the energy storage housing removably insertable into the handle.

12. The hand vacuum cleaner of claim 1 wherein the handle has a first end provided on the main body, an opposed second end and a hand grip portion positioned between the first end and the opposed second end of the handle, and the energy storage housing is insertable into the second end of the handle.

13. The hand vacuum cleaner of claim 1 wherein, in use, the motor axis of rotation intersects the second portion of the energy storage housing.

14. The hand vacuum cleaner of claim 1 wherein a rearward projection of the rear end of the air treatment chamber extends, in a direction parallel to the centrally positioned longitudinal axis, through the energy storage housing prior to extending through the motor and fan assembly.

15. A hand vacuum cleaner comprising:

(a) an airflow path from a dirty air inlet positioned at a front end of the hand vacuum cleaner to a clean air outlet positioned rearward of the dirty air inlet;

(b) an air treatment assembly comprising an air treatment chamber, the air treatment chamber positioned in the airflow path, the air treatment chamber has an air treatment chamber air inlet, an air treatment chamber air outlet, a front end, a rear end and a centrally positioned longitudinal axis extending between the front and rear ends of the air treatment chamber;

(c) a main body housing a motor and fan assembly that is positioned in the air flow path, the motor and fan assembly having a motor axis of rotation;

(d) a handle having a first end, an opposed second end, a hand grip portion positioned between the first end and the opposed second end of the handle and a handle axis that extends through the hand grip portion from the first end to the opposed second end; and, (e) an energy storage housing comprising a plurality of energy storage members that have a length, which is a longest dimension of the energy storage member, and in use the length extends in a direction of the handle axis, wherein, in use, the motor axis of rotation intersects the energy storage housing and the motor and fan assembly is located rearward of at least one of the energy storage members, and wherein, in use, the centrally positioned longitudinal axis intersects the energy storage housing.

16. The hand vacuum cleaner of claim 15 wherein, in use, a portion of the energy storage housing is positioned in the main body.

17. The hand vacuum cleaner of claim 15 wherein, in use, a portion of the energy storage housing is positioned rearward of a pre-motor filter.

18. A hand vacuum cleaner comprising:

(a) an airflow path from a dirty air inlet positioned at a front end of the hand vacuum cleaner to a clean air outlet positioned rearward of the dirty air inlet;

(b) an air treatment assembly comprising an air treatment chamber, the air treatment chamber positioned in the airflow path, the air treatment chamber has an air treatment chamber air inlet, an air treatment chamber air outlet, a front end, a rear end and a longitudinal axis that extends between the front and rear ends of the air treatment chamber;

(c) a main body housing a motor and fan assembly that is positioned in the air flow path, the motor and fan assembly having a motor axis of rotation;

(d) a handle having a first end, an opposed second end, a hand grip portion positioned between the first end and the opposed second end of the handle and a handle axis that extends through the hand grip portion from the first end to the opposed second end; and, (e) an energy storage housing comprising a plurality of energy storage members that have a length, which is a longest dimension of the energy storage member, and in use the length extends in a direction of the handle axis, wherein, in use, the longitudinal axis intersects the energy storage housing and the motor and fan assembly is located rearward of at least one of the energy storage members.

19. The hand vacuum cleaner of claim 18 wherein, in use, a portion of the energy storage housing is positioned in the main body.

20. The hand vacuum cleaner of claim 18 wherein, in use, a portion of the energy storage housing is positioned rearward of a pre-motor filter.

* * * * *